US007926912B2

(12) United States Patent
Murakami et al.

(10) Patent No.: US 7,926,912 B2
(45) Date of Patent: Apr. 19, 2011

(54) LIQUID DISCHARGE METHOD, LIQUID DISCHARGE HEAD AND LIQUID DISCHARGE APPARATUS

(75) Inventors: Shuichi Murakami, Kawasaki (JP); Yasunori Takei, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 259 days.

(21) Appl. No.: 12/359,522

(22) Filed: Jan. 26, 2009

(65) Prior Publication Data

US 2009/0174752 A1 Jul. 9, 2009

Related U.S. Application Data

(60) Division of application No. 11/683,154, filed on Mar. 7, 2007, now Pat. No. 7,506,962, which is a continuation of application No. PCT/JP2006/324315, filed on Nov. 29, 2006.

(30) Foreign Application Priority Data

Nov. 29, 2005 (JP) ..... 2005-343943

(51) Int. Cl.
*B41J 2/14* (2006.01)
*B41J 2/16* (2006.01)

(52) U.S. Cl. ..... 347/47; 347/44; 347/56

(58) Field of Classification Search ..... 347/20, 347/44, 47, 56, 61–65, 67, 92–94
See application file for complete search history.

(56) References Cited

U.S. PATENT DOCUMENTS

| | | | | |
|---|---|---|---|---|
| 6,123,413 | A | 9/2000 | Agarwal et al. | |
| 6,254,219 | B1 | 7/2001 | Agarwal et al. | |
| 6,350,016 | B1 | 2/2002 | Tachihara et al. | |
| 6,371,596 | B1 * | 4/2002 | Maze et al. | 347/47 |
| 6,520,626 | B1 | 2/2003 | Murakami | |
| 6,527,369 | B1 * | 3/2003 | Weber et al. | 347/47 |
| 6,557,974 | B1 | 5/2003 | Weber | |
| 6,971,736 | B2 | 12/2005 | Tomizawa et al. | |
| 6,984,026 | B2 | 1/2006 | Tomizawa et al. | |

FOREIGN PATENT DOCUMENTS

| | | |
|---|---|---|
| JP | 2-2004 | 1/1990 |
| JP | 10-235874 | 9/1998 |
| JP | 2000-280479 | 10/2000 |

OTHER PUBLICATIONS

International Preliminary Report on Patentability and English translation, International Application No. PCT/JP2006/324315, filed on Nov. 29, 2006.

* cited by examiner

*Primary Examiner* — Juanita D Stephens
(74) *Attorney, Agent, or Firm* — Fitzpatrick, Cella, Harper & Scinto

(57) ABSTRACT

A liquid discharge head is arranged in a manner that in the cross-section of a discharge port in a liquid discharge direction, the discharge port includes at least one projection that is convex inside the discharge port; a first area, for holding a liquid surface connecting a pillar-shaped liquid that is elongated outside the discharge port; and second areas where a fluid resistance is lower than that in the first area so as to pull the liquid in the discharge port in a direction opposite to the liquid discharge direction. The first area is formed in the direction in which the projection is convex, and the second areas are formed on both sides of the projection.

6 Claims, 19 Drawing Sheets

LIQUID DISCHARGE METHOD, LIQUID DISCHARGE HEAD AND LIQUID DISCHARGE APPARATUS

This application is a division of U.S. patent application Ser. No. 11/683,154, filed Mar. 7, 2007, now U.S. Pat. No. 7,506,962, issued Mar. 24, 2009, which is a continuation of PCT/JP2006/324315, filed Nov. 29, 2006.

This application is a continuation of International Application No. PCT/JP2006/324315 filed on Nov. 29, 2006, which claims the benefit of Japanese Patent Application No. 2005-343943 filed on Nov. 29, 2005.

BACKGROUND OF THE INVENTION

1. Field of the Invention

The present invention relates to a liquid discharge head that performs recording by discharging liquid droplets onto a medium, a liquid discharge apparatus, a head cartridge and a liquid discharge method.

2. Description of the Related Art

As a system for discharging a liquid such as ink, a liquid discharge system (ink jet recording system) has been developed, and as a discharge energy generating element, used for discharging liquid droplets, a method that uses a heat generating element (a heater) is available.

FIG. 10 is a schematic diagram showing a general discharge process, for a bubble jet (BJ) discharge system, that employs a conventional ink jet head for preventing bubbles from communicating with the atmosphere. It should be noted that, for convenience sake, in this case a liquid portion that is externally ejected through an orifice plate, wherein a discharge port is formed, is called discharged liquid, and liquid remaining within the discharge port is called flow path liquid, in order to distinguish between these liquid portions.

First, in a state (a) of FIG. 10, a film boiling phenomenon is produced at the surface of the heater by electrifying the heater ((b) of FIG. 10). Through energy generated by this film boiling, liquid is forced outward, from the surface of the orifice plate in which the discharge port is formed ((c) of FIG. 10). At this time, impelled by the inertial force of the energy generated by the film boiling, the liquid near the heater is moved, as a bubble, away from the heater. Since the interface status of the bubble and the liquid is altered by this movement of the liquid, gas near the heater behaves as though it were growing. However, the state, at this time, is insulated from the heat produced by the heater, and heat is not transmitted to the bubble, so that as the bubble grows, the pressure of the gas is reduced. Furthermore, the inertial force also increases the quantity of the liquid that is discharged. When the inertial force of this liquid finally becomes proportional to a recovery force that accompanies the reduction in the pressure of the gas, growth of the bubble is halted, and a maximum bubble state is achieved ((d) of FIG. 10). Since the gas portion in the maximum bubble state is under a pressure sufficiently lower than the atmosphere, thereafter, the bubble begins to disappear, and the liquid in the surrounding area is rapidly drawn into the space once occupied by the bubble ((e) of FIG. 10). In accordance with the movement of the flow path liquid that accompanies the disappearance of the bubble, a force that draws the liquid near the discharge port towards the heater is also exerted. Since the velocity vector of this force is in the direction opposite to that of the velocity vector for the flying, discharged liquid, liquid having the shape of a pillar (a liquid pillar) is formed between a spherical portion, which serves as the main droplet, and a flow path liquid, and is stretched. As a result, the liquid pillar portion becomes elongated ((f) of FIG. 10). And when some time has elapsed following the disappearance of the bubble, the discharged liquid, which can no longer maintain the liquid pillar state, is separated by breaking away, countering the viscosity of the liquid, and becomes a separate liquid droplet ((g) of FIG. 10). At the time of this scattering that produces the liquid droplet, a tiny mist is formed. Finally, the flying liquid droplet is further separated, forming a main droplet and a sub-droplet (a satellite), in accordance with a velocity difference between the two and the surface tension of the liquid ((h) of FIG. 10). Since the satellite is flying to the rear of the main droplet, when it is attached to the paper surface the landing position is shifted away from that of the main droplet. This results in the degradation of the image quality.

FIG. 12 is a schematic diagram showing a general discharge process performed by a bubble through jet (BTJ) discharge system, employing a conventional ink jet head, whereby bubbles communicate with the atmosphere. The height of a flow path is formed lower than that of the BJ discharge system in FIG. 10. An explanation will not be given for the same portion as that for the BJ discharge system in FIG. 10. While referring to a bubble disappearance process ((e) to (g) of FIG. 12), the way in which a meniscus is pulled inside a discharge port differs between a location at the front, in an ink flow path, and at the rear, in the ink flow path, so that the meniscus becomes asymmetrical ((f) of FIG. 12). Therefore, when a discharged droplet is separated from the meniscus, the rear tail end portion of the discharged droplet is bent ((g) of FIG. 10). Thus, a satellite generated at the bent tail portion would fly along a trajectory shifted away from that of a main droplet, and land at a position separate from that of the main droplet.

Recently, for an ink jet printer for which a high definition image, such as that for photographic output, is requested, it is preferable that the formation of satellites that cause image quality to be deteriorated be reduced to the extent possible. Relative to a process for reducing the formation of satellites, as described, for example, in Japanese Patent Application Laid-Open No. H10-235874, it is known that the length of the tail (the ink tail) of a flying liquid droplet is reduced. It is further disclosed in Japanese Patent Application Laid-Open No. H10-235874 that the interval between discharge ports is locally reduced to increase the meniscus force, and the fluctuation of the liquid surface at a discharge port is reduced by the meniscus force and shortens the tail of a flying liquid droplet.

SUMMARY OF THE INVENTION

Problems to be Solved by the Invention

However, the arrangement in Japanese Patent Application Laid-Open No. H10-235874 is provided on the assumption that a size larger than the discharge port used for a high image quality head, such as a photographic output head, is used and that the size of a liquid droplet that is to be discharged is also large. When the arrangement in Japanese Patent Application Laid-Open No. H10-235874 is employed for a head, such as a photographic output head, that discharges tiny liquid droplets, a liquid droplet separation mechanism is basically unchanged from the conventional one, and the value that can be gained by cutting the tail (the liquid droplet length) is at most about 5 μm, although this depends on the discharge velocity. That is, according to the arrangement in Japanese Patent Application Laid-Open No. H10-235874, when the quantity discharged is large, as in the conventional case, satellite reduction effects are obtained, to a degree. However, when the discharged quantity level is as small as that used for a head corresponding to one used to obtain the above described photographic quality, almost no satellite reduction effects are obtained.

Therefore, the present inventors considered that, in order to further shorten the length of a tail, for the reduction of a satellite, the time for the separation of the discharged liquid should be adequately advanced. That is, during a period wherein a discharged liquid, externally stretched outward from a discharge port, is separating from a liquid inside the discharge port, the head of the discharged liquid continues forward. Thus, the earlier the timing at which the discharged liquid separates from the liquid in the discharge port, the shorter the tail of a flying liquid droplet becomes. From this viewpoint, it is preferable that the separation timing for the discharged liquid be moved forward, up to the middle of the bubble disappearance process.

However, it is difficult to bring the separation timing forward for the discharged liquid while following suit the conventional separation mechanism.

Means for Solving the Problems

As means for solving the above described problems, according to the present invention, a liquid discharge head, wherein a liquid is discharged from a discharge port by applying energy to the liquid from an energy generating element, is arranged in that the discharge port includes, in a cross section of a discharge port related to a liquid discharge direction, at least one projection, which is convexly shaped and is formed inside the discharge port, a first area for holding a liquid surface that is to be connected to liquid in a pillar shape stretched outside the discharge port when liquid is discharged from the liquid port, and a second area to which a liquid in the discharge port is to be drawn in a direction opposite to the liquid discharge direction, and which has a fluid resistance that is lower than that of the first area; and the first area is formed in a direction in which the projection is convexly shaped, and the second area is formed on both sides of the projection.

Further, a liquid discharge head, wherein a liquid is discharged through a discharge port by applying energy to the liquid from an energy generating element, is arranged in that the discharge port includes, in a cross section of the discharge port, related to a liquid discharge direction, equal to or greater than three convex projections that have convex forms inside the discharge port; and $1.6 \geqq (x_2/x_1) > 0$ is satisfied when $x_1$ denotes the lengths of the projections related to a direction in which the projections are convexly formed, and $x_2$ denotes the widths of the roots of the projections related to a widthwise direction of the projections.

Furthermore, a liquid discharge head, wherein a liquid is discharged through a discharge port by applying energy to the liquid from an energy generating element, is arranged in that the discharge port includes, in a cross section of the discharge port, related to a liquid discharge direction, equal to or smaller than two projections that are convexly formed inside the projections; $M \geqq (L-a)/2 > H$ is established when, in the cross section of the discharge port, related to the liquid discharge direction, H denotes distances from the distal ends of the projections to an outer edge of the discharge port in a direction in which the projections are convexly formed, L denotes the maximum diameter of the discharge port, a denotes a half-width of the projections, and M denotes the minimum diameter of a virtual outer edge of the discharge port; and distal ends of the projections in the cross section of the discharge port have a shape having a curvature, or a shape having a linear portion perpendicular to a direction in which the projections are convexly formed.

A liquid discharge method of the present invention, whereby a liquid is discharged from a discharge port by applying energy to the liquid from an energy generating element, includes: driving a liquid through a discharge port, which includes, in a cross section of the discharge port, related to a liquid discharge direction, a first area and a plurality of second areas, fluid resistances of which are lower than the first area, so that a pillar-shaped liquid is stretched externally from the discharge port; holding, in the first area, a liquid surface that is connected to the pillar-shaped liquid stretched outside the discharge port, and at the same time, pulling a liquid in the discharge port in a direction opposite to the direction; and while holding the liquid surface in the first area, separating the pillar-shaped liquid, stretched outside the discharge port, from the liquid surface in the first area, and discharging the liquid from the discharge port.

ADVANTAGES OF THE INVENTION

As described above, according to the present invention, the timing at which a discharged liquid, stretched outside the discharge port, is to be separated from a liquid that remains in the discharge port can be considerably advanced, and a greater reduction in satellites and mists that deteriorate the image quality is enabled.

Further features of the present invention will become apparent from the following description of exemplary embodiments with reference to the attached drawings.

BRIEF DESCRIPTION OF THE INVENTION

In this specification, "recording" defines formation of meaningful information, such as drawings. Additionally, "recording" includes general formation of an image, a design, a pattern, etc., on a recording medium, regardless of whether meaningful or meaningless, and regardless of whether information is visualized so as to be visually perceived. Moreover, "recording" also includes a case of processing a medium by applying the liquid to the medium. Further, a "recording medium" represents not only paper used by a common recording apparatus, but also widely represents a medium that can accept ink, such as cloth, plastic film, a metallic plate, glass, ceramics, wood or leather. Furthermore, "ink" or a "liquid" represents a material that is to be applied to a recording medium to form images, designs, patterns, etc. Moreover, such a liquid is also included that is employed as a treatment agent to process a recording medium, or to coagulate a liquid applied to a recording medium or to prevent the dissolving of the liquid. A "fluid resistance" indicates ease of movement of a liquid, and for example, since a liquid is not easily moved within a narrow portion, the fluid resistance is increased, and within a broad portion, since the liquid is easily moved, the fluid resistance is lowered. It is assumed that terms, such as parallel, perpendicular and linear, used in this specification are regarded while a range that is about the equivalent of a manufacturing error is included.

About a Liquid Discharge Apparatus

Figure 7:
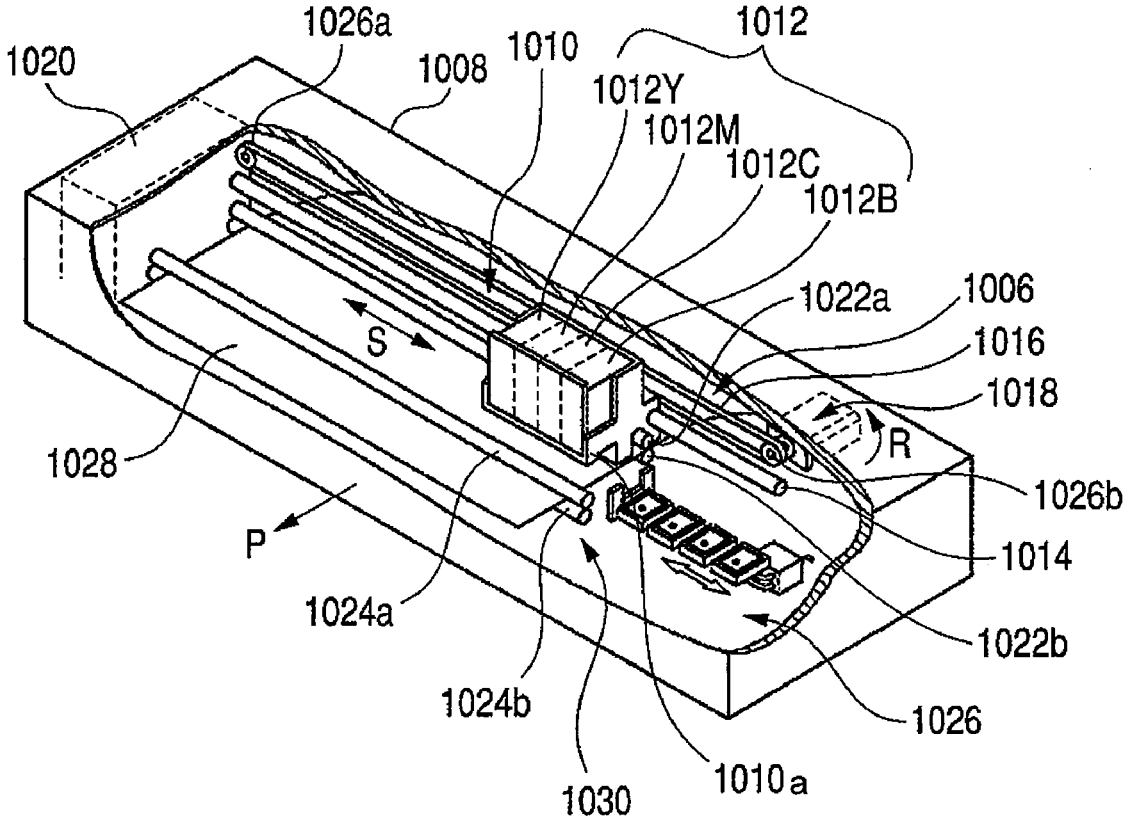
FIG. 7 is a schematic perspective view showing the essential portion of a liquid discharge apparatus applicable to the present invention.

FIG. 7 is a schematic perspective view showing a liquid discharge head for which the present invention is applicable, and the essential portion of an example liquid discharge recording apparatus (an ink jet printer) that serves as a liquid discharge apparatus that employs this head.

The liquid discharge recording apparatus includes, in a casing 1008, a conveying unit 1030 that intermittently conveys a sheet 1028, which is a recording medium, in a direction indicated by an arrow P. In addition, the liquid discharge recording apparatus includes: a recording unit 1010, which moves parallel to a direction S that is perpendicular to a direction P in which the sheet 1028 is conveyed, and for which a liquid discharge head is provided; and a movement driver 1006, which serves as driving means for reciprocating the recording unit 1010.

The conveying unit 1030 includes: a pair of roller units 1022*a* and 1022*b* and a pair of roller units 1024*a* and 1024*b*, which are arranged parallel to and opposite each other; and a driver 1020 which drives these roller units. When the driver 1020 is operated, the sheet 1028 is gripped by the roller units 1022*a* and 1022*b* and the roller units 1024*a* and 1024*b*, and is intermittently conveyed in the direction P.

The movement driver 1006 includes a belt 1016 and a motor 1018. The belt 1016 is wound around pulleys 1026*a* and 1026*b* which are fitted on rotary shafts at a predetermined interval, so that they are opposite each other and is positioned parallel to the roller units 1022*a* and 1022*b*. The motor 1018 moves, in the forward direction and in the reverse direction, the belt 1016 that is coupled with a carriage member 1010*a* of the recording unit 1010.

When the motor 1018 is operated and the belt 1016 is rotated in a direction indicated by an arrow R, the carriage member 1010*a* is moved, in the direction indicated by an arrow S, at a predetermined distance. Further, when the belt 1016 is moved opposite to the direction indicated by the arrow R, the carriage member 1010*a* is moved, opposite to the direction indicated by the arrow S, a predetermined distance. Furthermore, at a position used as a home position for the carriage member 1010*a*, a recovery unit 1026 for performing a discharge recovery process for the recording unit 1010, is arranged opposite the ink discharge face of the recording unit 1010.

The recording unit 1010 includes cartridges 1012, detachably provided to the carriage member 1010*a*. For individual colors, such as yellow, magenta, cyan and black, the cartridges 1012Y, 1012M, 1012C and 1012B are respectively prepared.

About Cartridge

Figure 8:
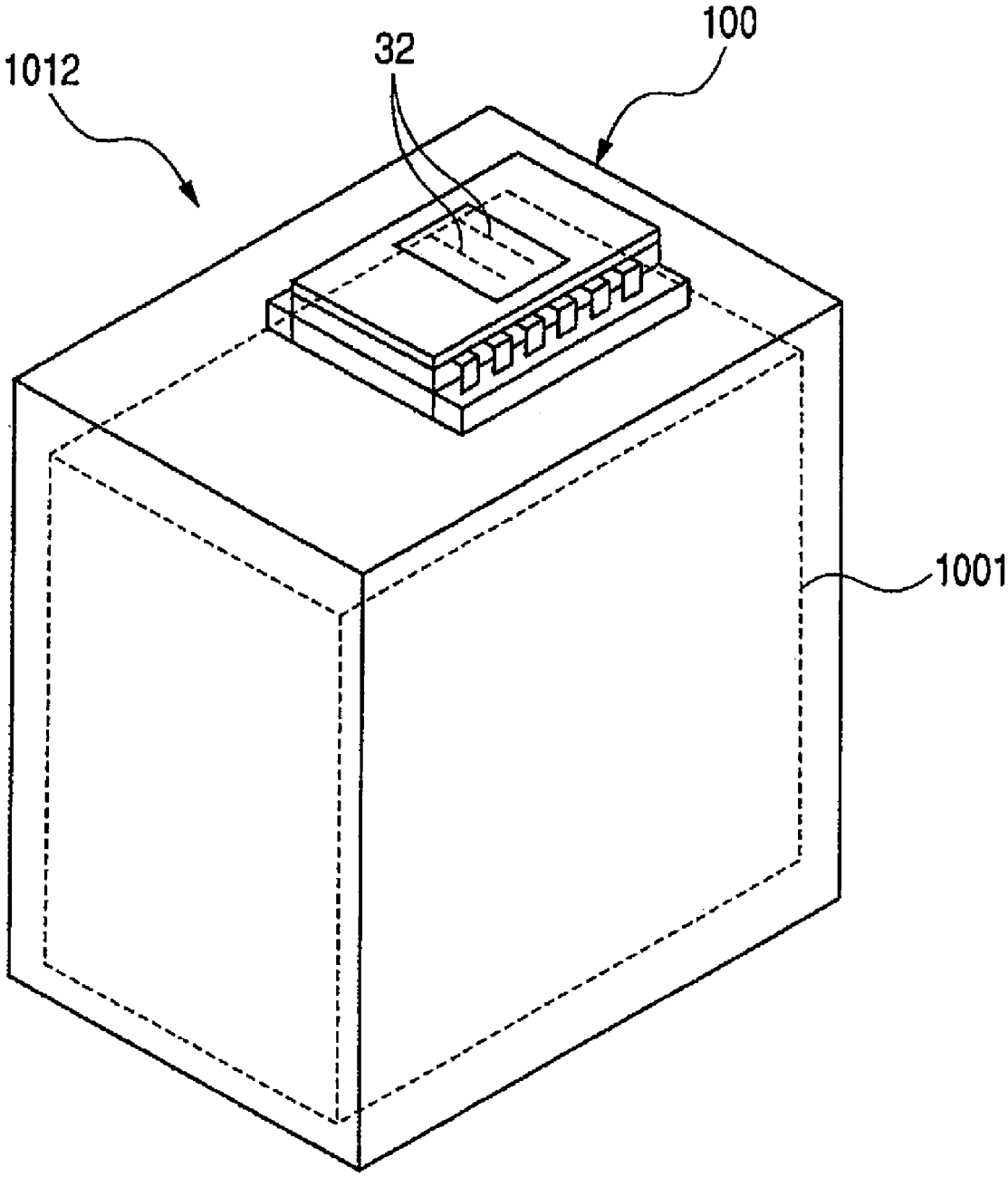
FIG. 8 shows a cartridge to be mounted on the liquid discharge recording apparatus applicable to the present invention.

FIG. 8 shows an example cartridge that can be mounted on the above described liquid discharge recording apparatus. The cartridge 1012 of this embodiment is a serial type, and the main section is constituted by a liquid discharge head 100 and a liquid tank 1001, in which a liquid, such as ink, is to be retained. The liquid discharge head 100, where multiple discharge ports 32 are formed for discharging a liquid, is compatible with the individual embodiments that will be described later. A liquid, such as ink, is to be introduced, from the liquid tank 100, through a liquid supply path (not shown) to a common liquid chamber of the liquid discharge head 100. For the cartridge 1012 of this embodiment, the liquid discharge head 100 and the liquid tank 1001 are integrally formed. However, a structure wherein a liquid tank 1001 may be connected to a liquid discharge head 100, so that it is replaceable, may be employed.

An explanation will now be given for a liquid discharge head mountable on the above described liquid discharge recording apparatus.

Structure of a Liquid Discharge Head

Figure 9A:
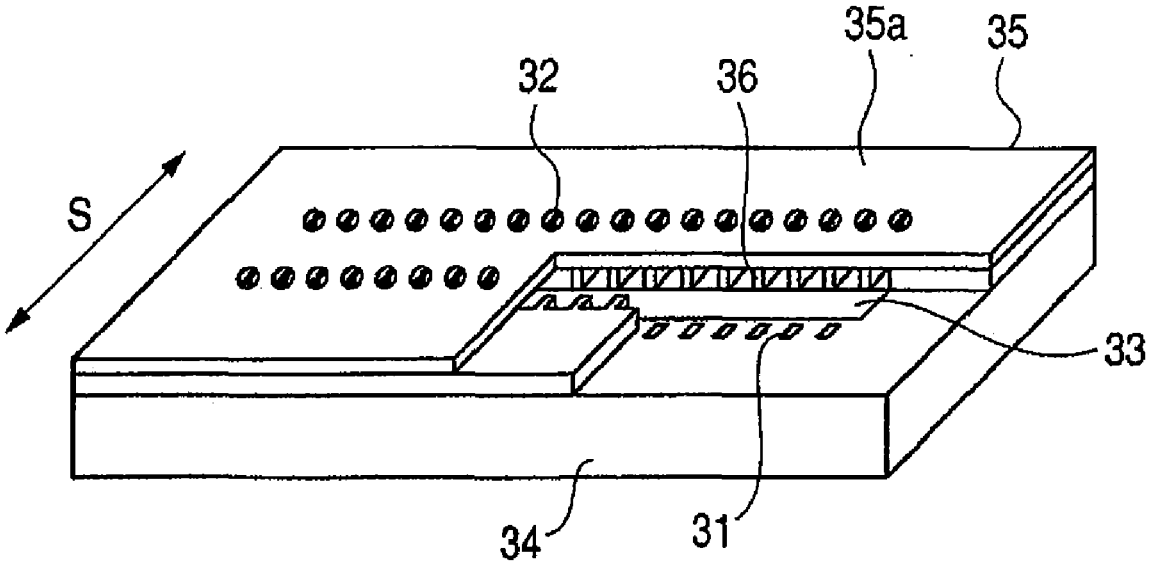
FIGS. 9A and 9B are a schematic perspective view of the essential portion of a liquid discharge head applicable for the present invention and an enlarged diagram for a discharge port.

FIG. 9A is a schematic perspective view specifically showing the essential portion of a liquid discharge head applicable to the present invention, and for example, electric wiring for driving a heat generating element is not shown. Arrows S in FIG. 9A indicate directions (main scanning directions) in which the head and a recording medium are moved, relative to each other, during a recording operation in which the head discharges liquid droplets. In this embodiment, as shown in FIG. 7, an example is shown in which the head moves relative to a recording medium during the recording operation.

A substrate 34 includes a supply port 33, which is a through hole shaped like a long groove, to supply a liquid to a flow path. Heat generating elements (heaters) 31 which are thermal energy generation means are arranged as an array at intervals of 600 dpi, and this array is positioned in a zigzag manner, on either side of the supply port in the longitudinal direction, so that 1200 dpi is obtained. A flow path wall 36 and a discharge port plate 35 having discharge ports 32 are provided to the substrate 34 as flow path formation members for forming flow paths.

Shape of Discharge Ports

Figure 1A:
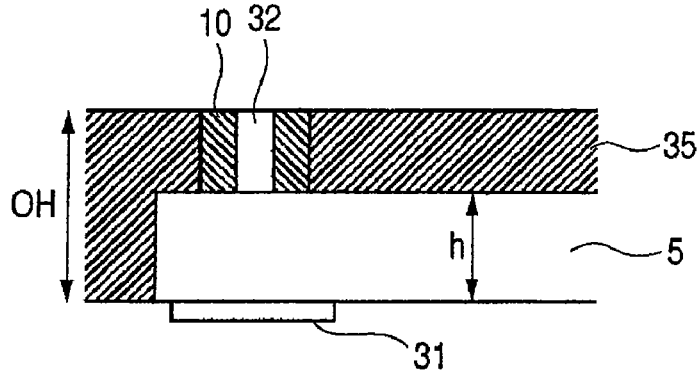
FIGS. 1A, 1B and 1C are a cross sectional view of a nozzle for a liquid discharge head applicable to the present invention, and diagrams respectively showing the shape of a heater and a flow path viewed from a discharge port, and the shape of the discharge port.
Figure 1B:
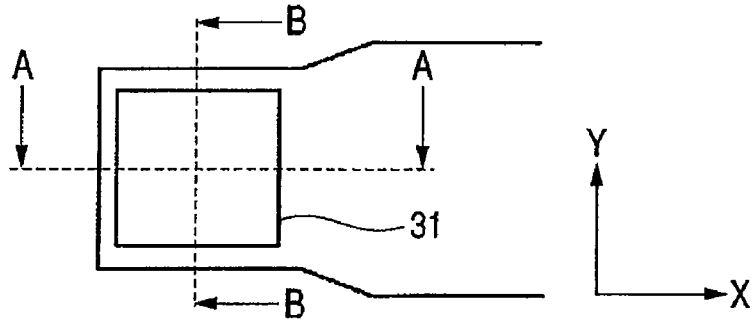
Figure 1C:
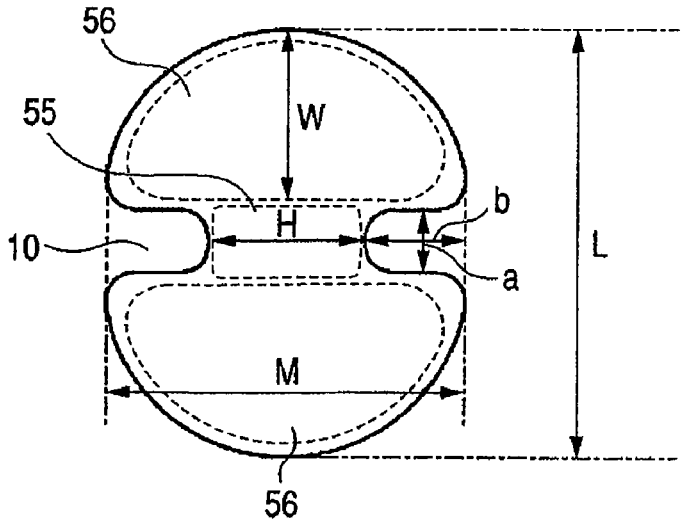

The shape of discharge port applicable for the present invention will be explained by employing FIGS. 1A, 1B and 1C. FIG. 1A is a cross-sectional view of a nozzle, FIG. 1B is a view of the shapes of a heater and a flow path. FIG. 1C shows the shape of a discharge port.

As shown in FIG. 1C, the shape of the discharge port of this invention has a characteristic in that at least one projection is formed inward in the discharge port relative to the outer edge. The projections are formed symmetrically, and the minimum diameter H of the discharge port is formed at the gap between the projections. The width of the projection or the gap between the projections becomes a high fluid resistant area 55 that is a first area wherein fluid resistance is remarkably higher than that of the other portion of the discharge port. And on both sides (positions on both sides of the projections), at the boundary of the high resistant area 55, low fluid resistant areas 56 are provided as second areas. A point of this invention is that there is enough difference in the fluid resistance between the high fluid resistant area and the low fluid resistant area. Therefore, it is preferable that the projection be located locally, and that the fluid resistance in the low fluid resistant areas not be as high as that when projections are not formed. So long as this structure is employed, an arbitrary shape, such as a circle, an ellipse or a quadrilateral, may be employed for the outer edge of the discharge port.

Figure 9B:
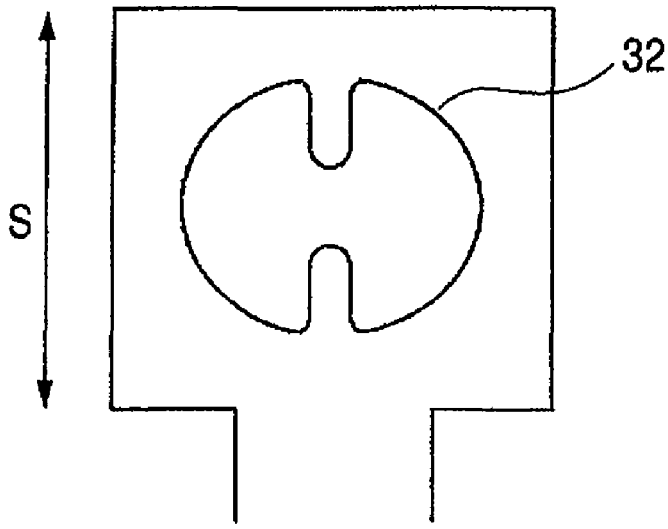

FIG. 9B is an enlarged diagram showing the example discharge port in FIG. 9A. Generally, degrading of the image quality due to liquid droplets landing at shifted positions on the face of paper occurs because a line is formed on a recording medium by liquid droplets that are discharged through the same discharge port. That is, the image quality is more greatly affected by the shifting of the positions of liquid droplets in a direction perpendicular to the head scanning direction than by shifting the positions of liquid droplets in the head scanning direction S. In the case of the discharge port shape shown in FIG. 9B, which has a pair of projections, when the projections are formed asymmetrically, because of a variance in the shapes of the projections, especially the lengths of the projections, liquid droplets that have landed are shifted in a direction in which the projections are extended (direction S in FIGS. 9A and 9B). Thus, it is preferable that the projections in the discharge port be arranged parallel to the main scanning direction S of the head. With this arrangement, the affect on the image quality due to variances in the shapes of the projections can be reduced. Furthermore, also for a case wherein a full-line head performs recording using a head equal to or greater than the width of a recording medium, it is preferable, for the same reason as above, that a projection be formed in the main scanning direction (the direction in which the head and a recording medium are moved relative to each other during a recording operation in which the head discharges liquid droplets).

Furthermore, it is preferable that a water repellent process be performed for a discharge port face (face opposite a recording medium) 35*a* and that the discharge port face side of a projection be a convex-shaped projection. Since a water repellent layer is formed on the discharge port face and the discharge face side of the projections, the rear portion of a liquid to be discharged is more smoothly separated.

About the Discharge Principle

In order to reduce satellite liquid droplets as previously described, it is effective for the length of a liquid droplet, from the distal end to the rear end, should be shortened. Thus, in this invention, a new separation mechanism for a liquid droplet is employed to move forward the timing for the separation of a liquid droplet. This discharge principle will be explained by using discharge process diagrams.

BJ Discharge Example

Figure 2:
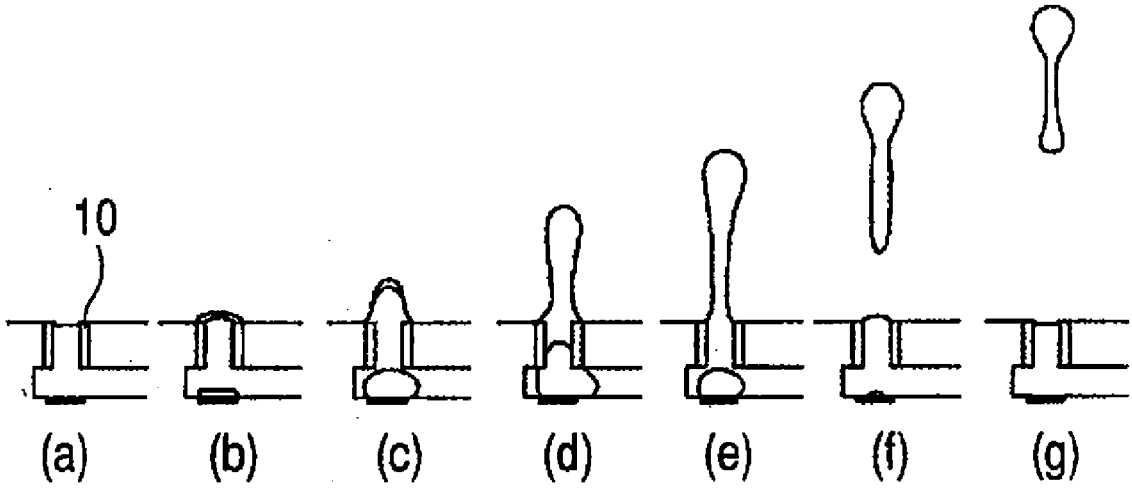
FIG. 2 is a diagram showing a discharge process in a head cross section taken along line A-A in FIG. 1B.
Figure 3:
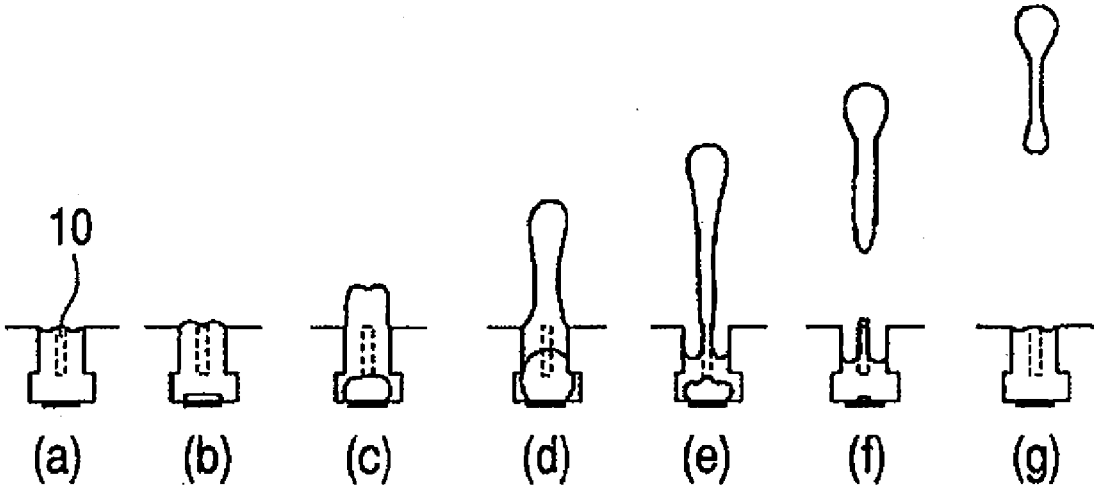
FIG. 3 is a diagram showing the discharge process in a head cross section taken along line B-B in FIG. 1B.

FIG. 2 is a diagram for a discharge process of this embodiment. FIG. 2 shows the discharge state of a bubble jet (BJ) discharge system whereby bubbles do not communicate with the atmosphere. (a) to (g) of FIG. 2 are head cross-sectional views taken along line A-A in FIG. 1B, and (a) to (g) of FIG. 3 are head cross-sectional views taken along line B-B in FIG. 1B. The individual steps at (a) to (g) in FIG. 2 correspond to those at (a) to (g) in FIG. 3.

First, since the bubble growth process from the state at (a) in FIG. 2 to the maximum bubble state at (d) in FIG. 2 is the same as that in the conventional case, no explanation for it will be given. The bubble in the maximum bubble state at (d) in FIG. 2 has grown while inside the discharge port.

The gas in the maximum bubble state is under pressure sufficiently lower than the atmosphere. Therefore, the volume of the bubble is thereafter reduced, and the surrounding liquid is rapidly drawn in to the location at which the bubble was. Because of this movement, also inside the discharge port, the liquid is returned toward the heater. However, since the discharge port is shaped as shown in FIG. 1C, the liquid is voluntarily drawn in from a location whereat a projection is not formed, i.e., a low fluid resistant portion. At this time, the liquid surface formed in the low fluid resistant portion which is located between the internal wall, the inner side face of the discharge port, and the pillar shaped liquid, is greatly retracted, assuming a concave shape, toward the heat generating element. On the other hand, at this time, the liquid tries to remain in the portion between the projections, i.e., a high fluid resistant portion. Thus, as shown in (e) of FIG. 2, the liquid inside the discharge port near the open end of the discharge port remains, so that the liquid surface (a liquid film) is extended only between the projections in the high fluid resistant portion. That is, the liquid surface that is connected to the pillar shaped liquid stretched outside the discharge port is held in the high fluid resistant area (the first area) and also, in a plurality of low fluid resistant areas (second areas), while the liquid inside the discharge port is drawn to the heater. As a resultant state, the liquid surface dropped greatly, forming a concave shape in multiple (two in this embodiment) low fluid resistant portions inside the discharge port. This state obtained for a pillar-shaped liquid (a liquid pillar) 52 is three-dimensionally shown in FIGS. 6A, 6B and 6C.

At this time, the quantity of the liquid that remains between the projections in the high fluid resistant portion is smaller than the liquid quantity defined according to the diameter of the pillar liquid, the liquid pillar is locally narrowed by the projections, and a "constricted part" is formed.

Figure 6A:
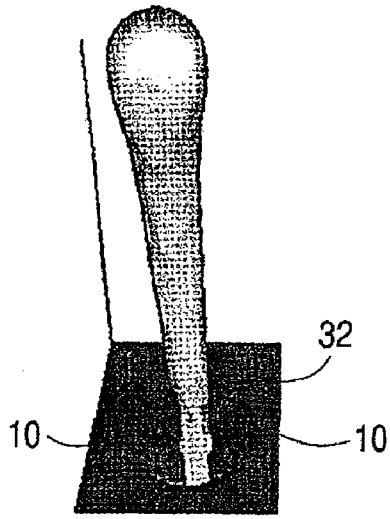
FIGS. 6A, 6B and 6C are schematic diagrams showing liquid discharges using the head in FIGS. 1A, 1B and 1C.
Figure 6B:
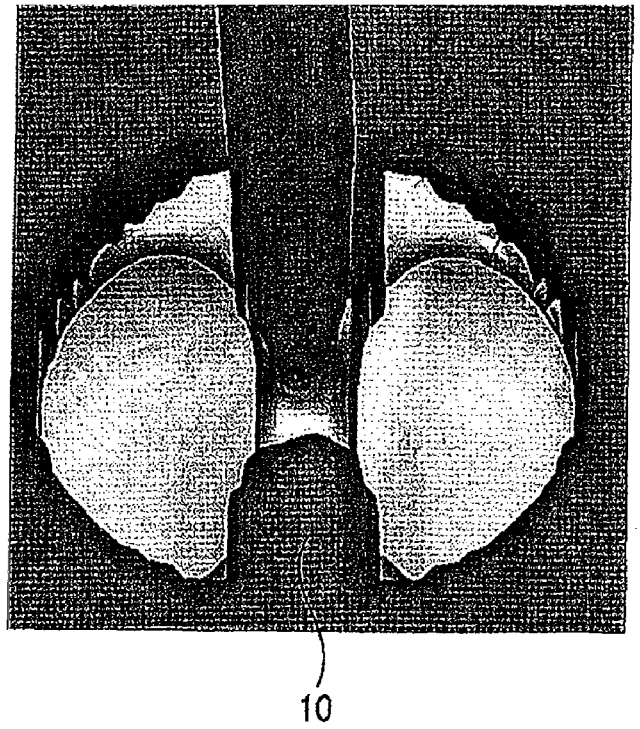

Here, FIG. 6A is a perspective view of a simulation showing the state of a liquid pillar viewed from a direction perpendicular to the projections. FIG. 6B is an enlarged perspective view of a simulation showing the "constricted part" of the liquid pillar. The "constricted part", formed at the root of the liquid pillar by the upper portions of the projections, is depicted in both directions in FIGS. 6A and 6B.

Figure 6C:
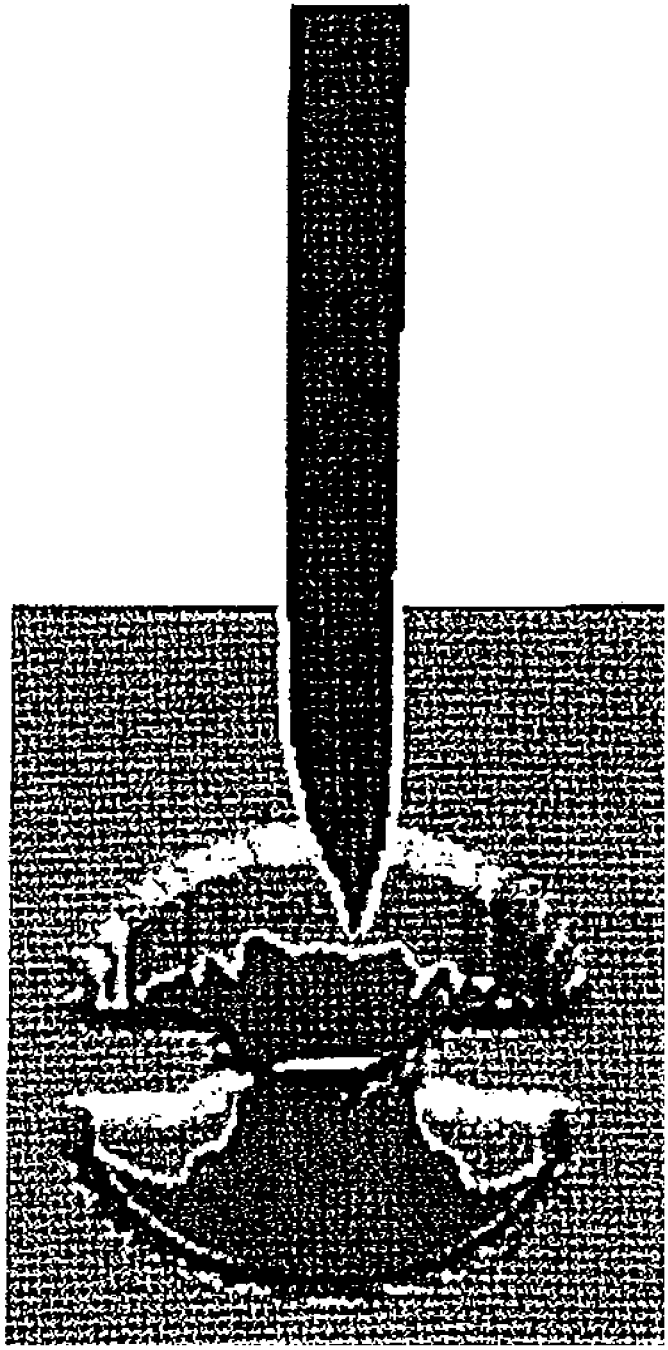

Thereafter, the liquid surface (the liquid film), connected to the liquid pillar stretching outside the discharge port, is held in the high fluid resistant area between the projections, and separation of the liquid pillar stretching outside the discharge port is performed in the constricted part of the liquid pillar that is formed in the high fluid resistant area at the upper portions of the projections (FIG. 6C). Since the discharged liquid is separated in accordance with this timing, the separation time can be adjusted so that it occurs earlier than the conventional time by 1 to 2 μsec, or more. That is, assuming that the discharge velocity of a liquid droplet is 15 m/sec, the length of a tail is reduced by equal to or more than 15 to 30 μm.

At this time, almost no force is exerted on the liquid between the projections for pulling the liquid in to the heater in association with the bubble disappearance. Therefore, unlike in the conventional case, the velocity vector does not indicate a direction opposite to that of the velocity vector of the flying, discharged liquid, and the velocity at the rear end of the liquid droplet is adequately swifter than the conventional velocity. Further, a phenomenon wherein the liquid pillar portion of the discharged liquid is stretched and substantially elongated does not occur, and as a result, the discharged liquid is smoothly separated. And a mist that conventionally occurs upon the separation of the discharged liquid (the liquid pillar) is remarkably suppressed.

Then, the rear end of the flying liquid droplet becomes spherical, due to surface tension, and is separated into a main droplet and a sub-droplet (satellite). It should be noted that when the difference is very small between the velocity at the rear end of the liquid droplet and the velocity at the distal end, the separated satellite combines during flight, or on the paper face, and an elongated, substantially separate satellite is prevented from forming.

Figure 4:
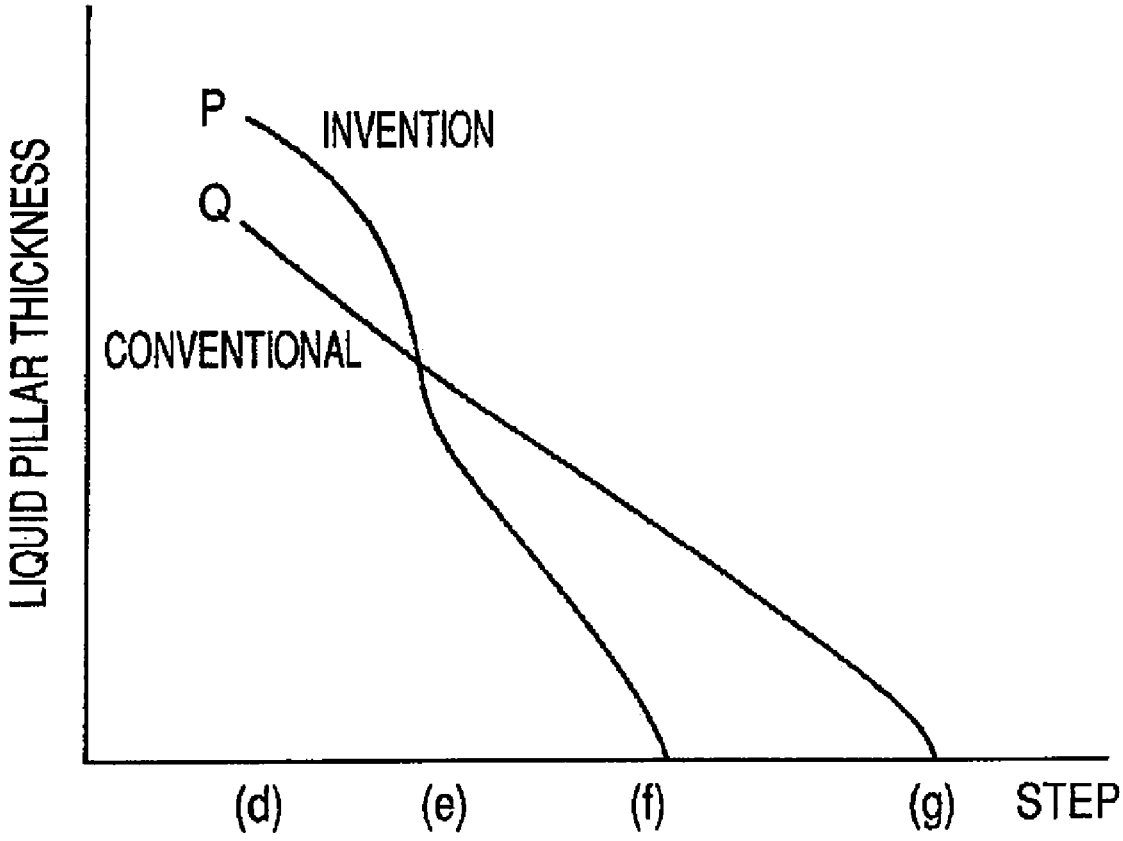
FIG. 4 is a graph showing a relationship between the minimum diameters for the thicknesses of liquid pillars and the discharge processes in FIGS. 2 and 10.
Figure 10:
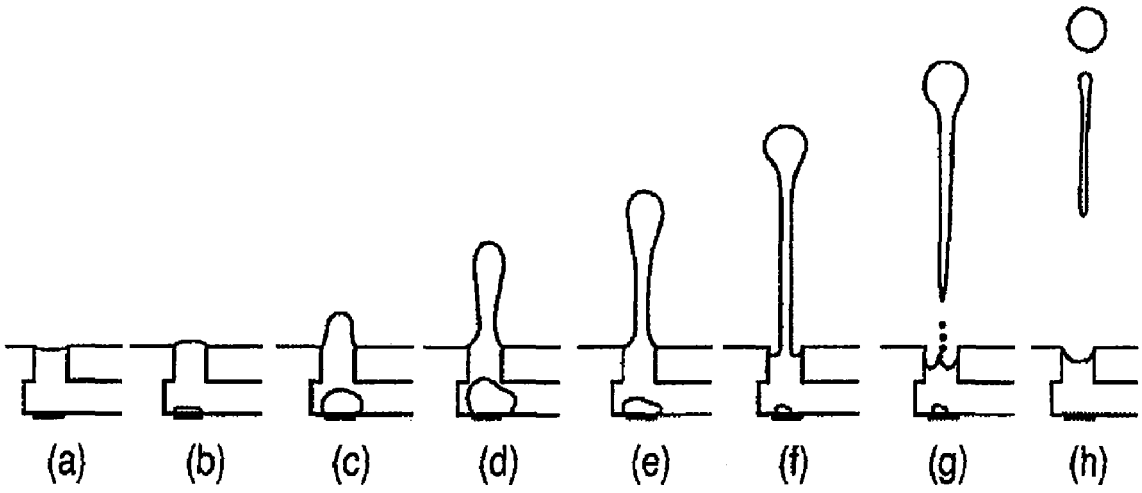
FIG. 10 is a diagram showing a discharge process for a BJ discharge system employing a conventional circular discharge port.

FIG. 4 is a graph of the relationship between the minimum diameters for the thicknesses of liquid pillars in FIG. 2 (line P), and shows the discharge process of this invention, and in FIG. 10 (line Q) is shown the conventional discharge process and the discharge steps. It should be noted that the minimum diameter for the thickness of the liquid pillar is the diameter of the portion, of a liquid pillar forced out through the discharge port, and has the smallest cross section, in the discharge direction, except for the spherical portion that serves as the main droplet. Further, (d) to (g) along the horizontal axis correspond to the individual steps in FIGS. 2 and 10.

In FIG. 4, the thicknesses of the initial liquid pillars differ, because the discharge port for this invention is formed by dividing a conventional circular discharge port into two semicircular segments and inserting projections between the semicircular segments, so that the maximum diameter of the discharge port is increased, compared with the conventional one.

As illustrated, according to the conventional arrangement, as time elapses, the minimum diameter for the thickness of the liquid pillar is reduced at almost a steady rate. On the other hand, according to the arrangement of the invention, it is found that, during the bubble disappearance process, the change rate changes suddenly, due to the time required to attain the minimum diameter for the thickness of the liquid pillar. This is probably because, as previously described, due to pulling of the local meniscus, accompanied by the bubble disappearance, the quantity of the liquid that contacts the liquid pillar held by the projections is suddenly reduced, and a constricted part is formed at the root of the liquid pillar. Thus, at step (e), it is felt that the thickness of the liquid pillar becomes extremely small, and the separation time for the discharged liquid is advanced and occurs earlier than it does for the conventional time.

Example BTJ Discharge

Figure 13:
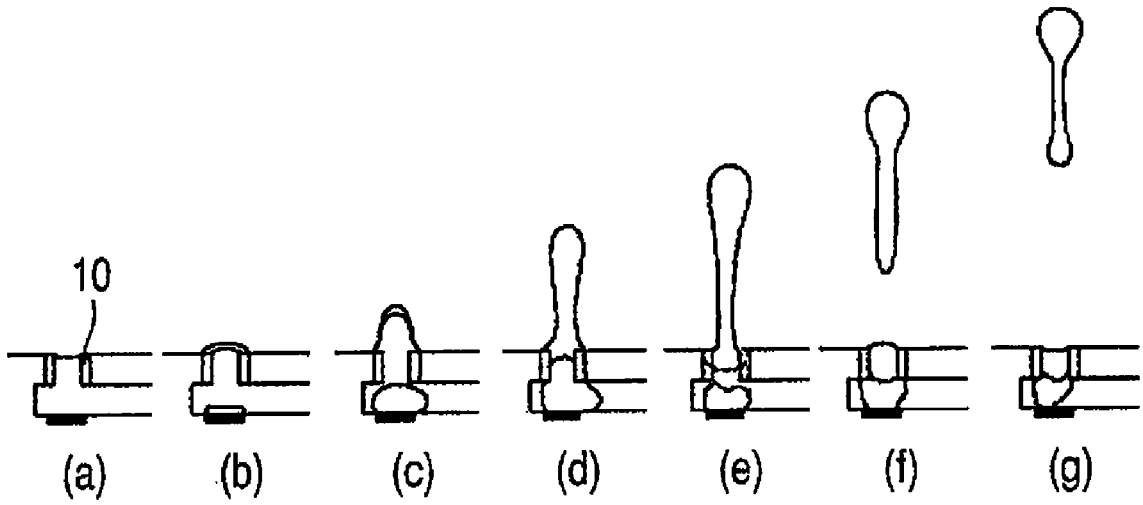
FIG. 13 is a diagram showing a discharge process for a BTJ discharge system according to one embodiment, viewed in the direction perpendicular to a projection.
Figure 14:
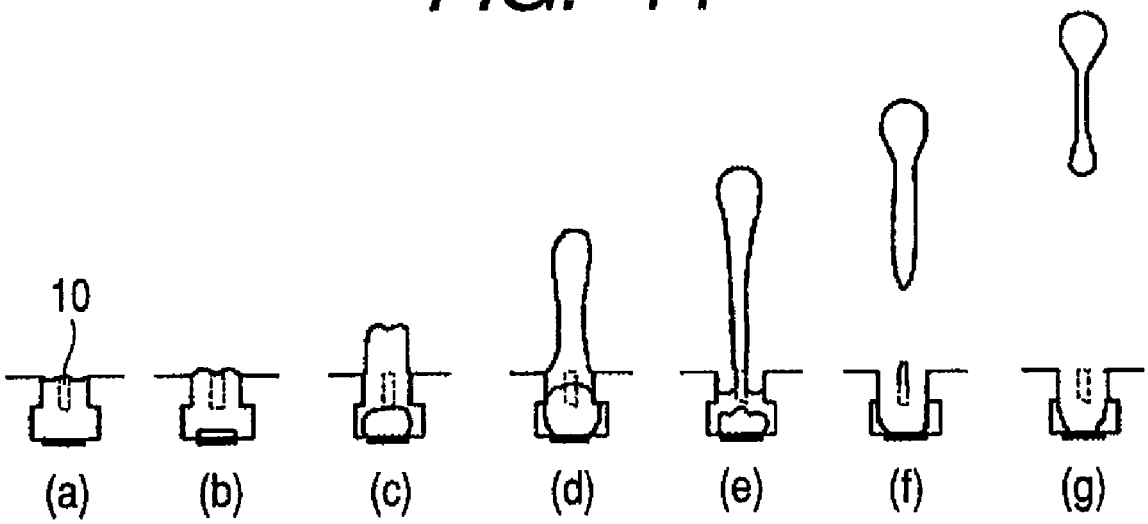
FIG. 14 is a diagram showing a discharge process, viewed from the projection direction, for the BTJ discharge system according to the embodiment.

FIG. 13 is a schematic diagram for the discharge state, of this embodiment, for a BTJ (bubble through jet) during which bubbles communicate with the atmosphere. (a) to (g) of FIG. 13 are head cross-sectional views, taken from a direction perpendicular to a projection, and (a) to (g) of FIG. 14 are head cross-sectional views, taken from the direction at a projection. Steps (a) to (g) in FIG. 13 correspond to those of (a) to (g) in FIG. 14. An explanation for the portion corresponding to that of the above described BJ discharge system will be omitted. As a condition for the performance of BTJ, a distance OH, from a heater to a discharge port, need only be reduced (to 20 to 30 μm), compared with the previous BJ example (FIGS. 1A, 1B and 1C). Thus, a bubble grows further upward (the discharge port direction) ((d) of FIG. 13), and a meniscus is retracted further inward to the discharge port, and communicates with a bubble in a nozzle ((f) of FIG. 13). In this manner, in low fluid resistant areas, the meniscus is easily retracted, and the state wherein a liquid film is extended between the projections, is prepared at an earlier timing, and the separation time for a liquid droplet is moved forward.

Figure 12:
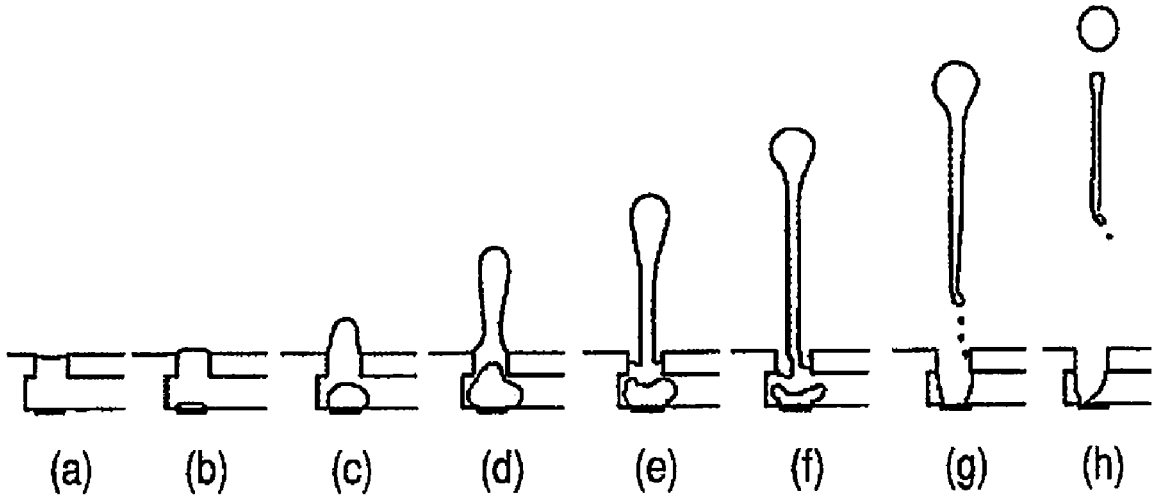
FIG. 12 is a diagram showing a discharge process for a BTJ discharge system that employs a conventional circular discharge port.

Furthermore, in the case, as shown in FIG. 12 of the employment status, of a conventional discharge port that does not have a projection, the rear end of the tail of a discharged liquid droplet is bent, and a satellite flies along a trajectory that is shifted away from that of the main droplet. However, when projections are formed as in this embodiment, when compared with the conventional BTJ, not only is the effect obtained whereby the separation time for the discharge liquid droplet is moved forward and the tail is shortened, but also is the effect produced whereby the tail bending shown in (g) of FIG. 12 is prevented at the time of separation. This is because, as shown in FIGS. 13 and 14, the separation of a liquid droplet is performed between the projections at the discharge port, and thus, while always in the center of the discharge port, the liquid droplet is separated. Therefore, the linearity of the trajectory is maintained for the flight of a discharged liquid droplet, and the occurrence of a satellite and of the deterioration of an image can be prevented.

About the Shape of Projections

The preferred shape of a projection employed for this invention will now be explained in more detail. The shape of a projection here represents the shape of a projection, taken when a discharge port is viewed from a liquid discharge direction, i.e., the cross sectional shape of a discharge port, related to the direction in which the liquid is to be discharged.

Figure 17:
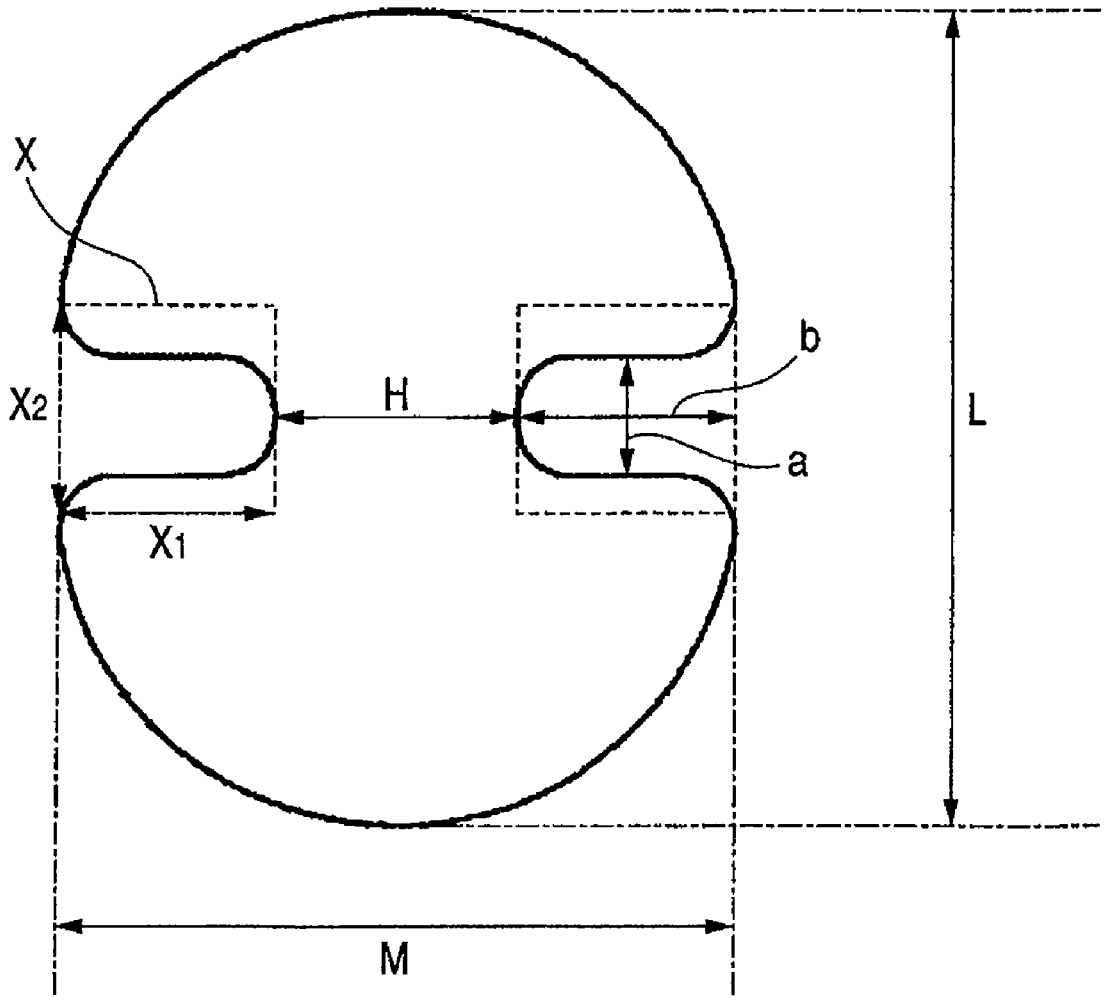
FIG. 17 is a schematic diagram for a discharge port applicable to this embodiment.

The shape of the discharge port in this embodiment is shown in FIG. 17. In order to appropriately form the high fluid resistant area 55 and the low fluid resistant areas 56 described above, it is preferable that a length W of the shortest portion in the low fluid resistant area be greater than the shortest distance (inter-projection gap) H formed by projections.

It should be noted that when the number of projections is two or smaller and when the width of a projection is substantially uniform, except for the distal end portion having a curvature and the root portion, $M\cdot(L-a)/2>H$ be satisfied, wherein M denotes the minimum diameter of the outer edge of a discharge port when a projection is not formed (in the case of two projections as in this embodiment, a distance from the root of one projection to the root of the other. In the case of one projection, a distance from the root of the projection to a corresponding edge); L denotes the maximum diameter of the discharge port; a denotes a half-width of a projection; and H denotes a distance from the distal end of a projection to the edge of the discharge port in a direction in which the projection is convex. Then, the balance appropriate for the discharge method of this invention is obtained between the area of the circular portion of the discharge port and the area between the projections. More preferably, $M \geqq (L-a)$. Further, the inter-projection gap H is greater than 0, and when a liquid film is held between the projections, the discharge system for this embodiment is provided.

X in FIG. 17 denotes a projection area. The projection area X is a rectangle or a square formed of two sides: the length of a projection ($x_1$: length from the root to the distal end of a projection) in a direction in which the projection is extended inside the discharge port (direction in which the projection is convex); and the width of the root of a projection in the widthwise direction of the projection ($x_2$: linear distance from the bent point at the root of the projection to the bent point on the opposite side across the distal end of the projection). When the bent points are not clear for $x_2$, two points of a tangent from the outer circumference of the discharge port to the root of the projection are regarded as bent points. In this embodiment, since projections are located in the range of $0<x_2/x_1 \leqq 1.6$, the force for holding a liquid surface between the projections can be increased, a meniscus between the projections can be appropriately maintained in the vicinity of the surface of the discharge port until the moment at which the liquid droplet is separated, and the length of the tail can be reduced. Further, since the range of $M \geqq (L-x_2)/2>H$ is established, the balance between the area of the semi-circular portions of the discharge port and the area between the projections is more appropriate for performing the discharge method of this invention.

In this invention, since a liquid film is formed and held between the projections, at an early stage after a liquid pillar is formed, the liquid pillar is cut on the side of the liquid film close to the surface of the discharge port, and is discharged as a liquid droplet. Thus, the tail of the discharged liquid droplet becomes short. That is, it is important that the liquid film is held between the projections until the moment at which the liquid droplet is separated, and it is necessary that the distal end of the projections should be shaped to easily hold the liquid film formed between the projections (easily maintain a surface tension).

Figure 20:
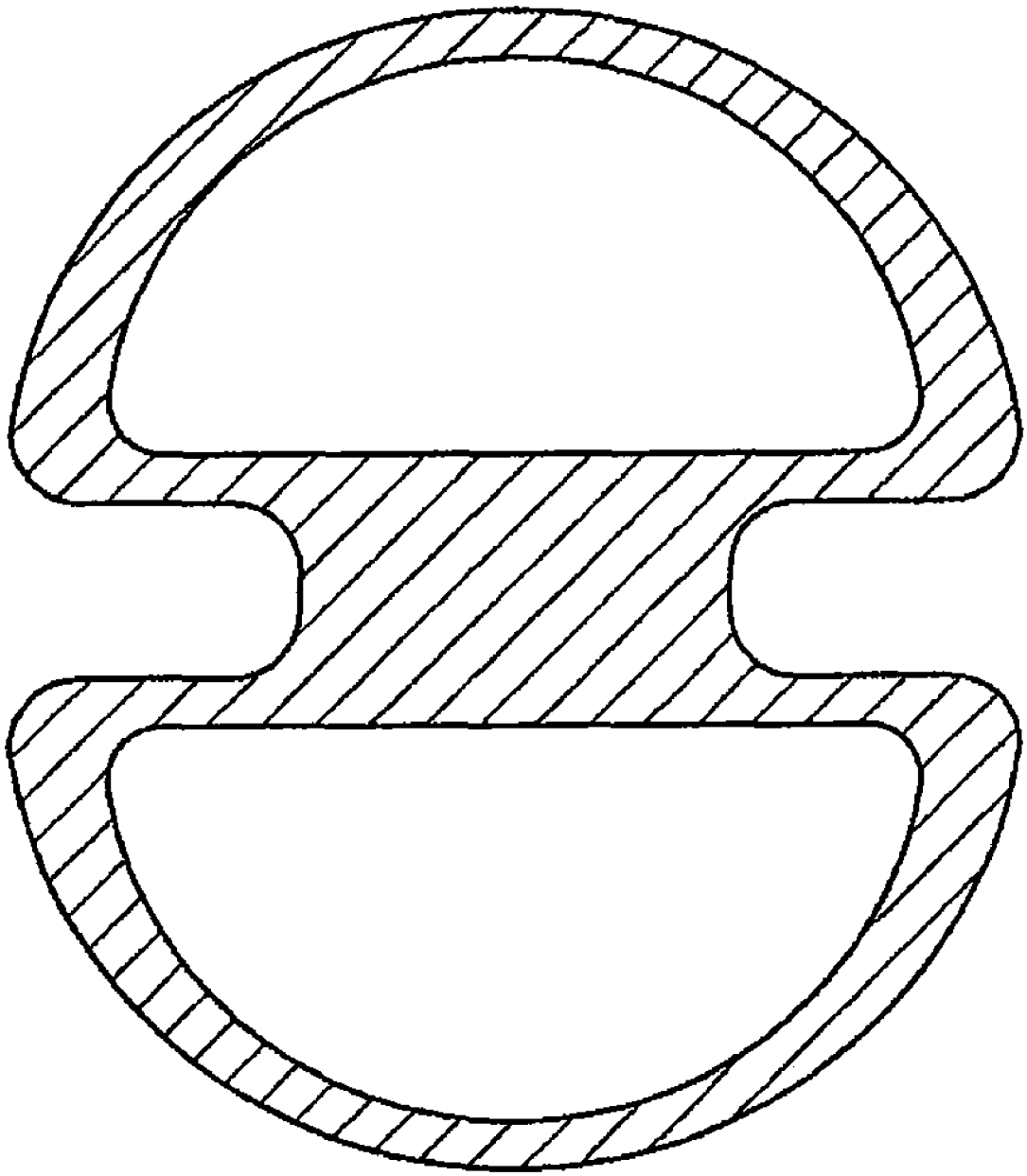
FIG. 20 is a schematic diagram showing projections for this embodiment and the movement of a liquid formed between them.

FIG. 20 is a schematic diagram for explaining the movement of a liquid inside the discharge port in a bubble fading process according to this embodiment. The discharge port of this embodiment employs a shape such that semicircular portions are developed, and projections are inserted in between. Therefore, in the bubble fading process, a force is exerted to low fluid resistant areas shown in FIG. 20, so that a meniscus is dropped to the heater side in a semi-circular form as indicated in white, and a liquid film between the projections tends to be held as indicated in a hatched manner. Further, linear portions are provided for both sides of the projections, and since the linear portions are parallel to each other, the meniscus at the low fluid resistant portions tends to be dropped more in the semi-circular manner. Furthermore, in this embodiment, an example where the distal end of a projection has a curvature has been shown; however, the distal end of a projection may be in a shape having linear portions perpendicular to a direction in which the projection is convex, e.g., the distal end of the projection may be a quadrilateral, and the effects of this embodiment are still obtained.

Since the projections and the shape of the discharge port described above are employed, the force for holding the liquid film between the projections is high, as shown in the simulation in FIGS. 6B and 6C. During a period in FIG. 6B which the liquid pillar is formed, and after FIG. 6C the liquid pillar is separated from the liquid film and flies, the liquid film is maintained between the projections. Therefore, the location where the liquid pillar is to be separated from the liquid film is close to the surface of the discharge port, so that the length of the tail of a liquid droplet to be discharged can be shortened, and this results in the reduction of satellites.

Additionally, as shown in the cross-sectional view in FIG. 1A, it is preferable that the central axis of the discharge port portion in the liquid discharge direction be perpendicular to the surface of the discharge port and the energy generating element, because of the symmetries of the positions of the meniscus and the stability of discharging. In the case wherein the central axis of the discharge port portion is not perpendicular to the surface of the discharge port or the heat generating element, at the bubble fading stage at which the meniscus position in the discharge port portion is moved toward the heat generating element, asymmetries for the meniscus positions are remarkable, and the effects of the invention can not be sufficiently obtained.

Projection Shapes for Comparison Examples

Figure 18A:
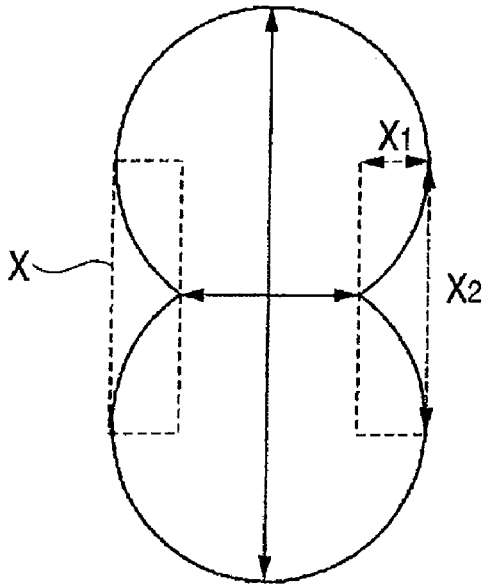
FIGS. 18A and 18B are schematic diagrams for a discharge port in a comparison example.
Figure 18B:
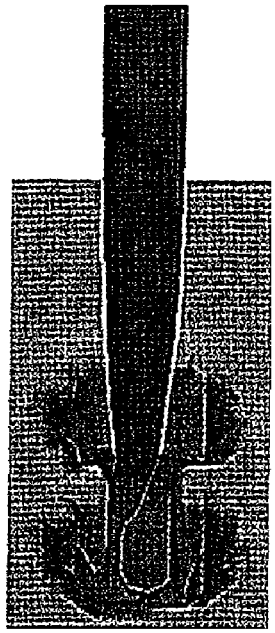

FIGS. 18A, 18B, 19A and 19B show the shapes of projections for comparison examples. A discharge port in FIG. 18A is a form provided by connecting two circles. The long side of the discharge port is defined as 20.0 μm, and the short side is defined as 4.5 μm. For a projection area X indicated by a broken lined quadrilateral in FIG. 18A, $x_1$ (direction toward the center of a discharge port) is regarded as 2.9 μm, and $x_2$ (width of the projection root) is regarded as 9.8 μm. $x_2/x_1=3.4$. A discharging simulation is shown in FIG. 18B, which corresponds to the interval between (e) and (f) in FIG. 3, or (e) and (f) in FIG. 14. While referring to FIG. 18B, before a liquid pillar is separated from a liquid in a discharge port, holding of a liquid between the projections begins to be broken, and a portion of the liquid pillar to be cut is dropped to the heater side in the discharge port. Therefore, the length of the tail of a liquid droplet to be discharged is not as short as in the shape provided by the embodiment, and this causes the occurrence of satellites.

Figure 21A:
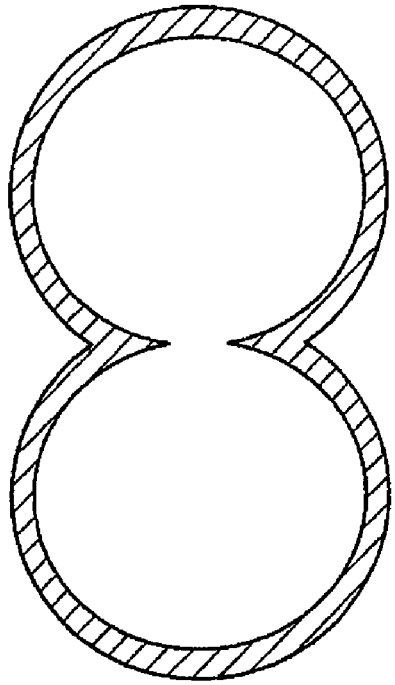
FIGS. 21A and 21B are schematic diagrams showing projections in the comparison examples and the movement of liquids formed between them.

This is because of the following reasons. Since the projections in FIG. 18B are abruptly sharpened close to the distal ends, and the shapes of the distal ends are pointed, a force different from that in the embodiment is exerted to the meniscus when a bubble is faded and the liquid in the discharge port is taken in to the heater side. During fading of a bubble, ink moves to the heater side slowly as it is close to the inner wall of the discharge port. Thus, as indicated by a shaded portion in FIG. 21A, the liquid remains along inside the discharge port, and indicated by a white portion, a force is exerted in the center of the discharge port to drop the meniscus in a form like connecting two circles. Thus, the liquid between the projections is pulled in to the heater side, and it is difficult that the liquid is held between the projections.

Figure 19A:
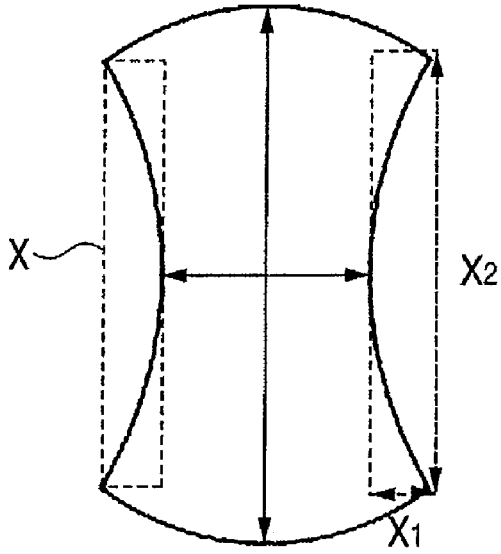
FIGS. 19A and 19B are schematic diagrams for a discharge port in a comparison example.
Figure 19B:
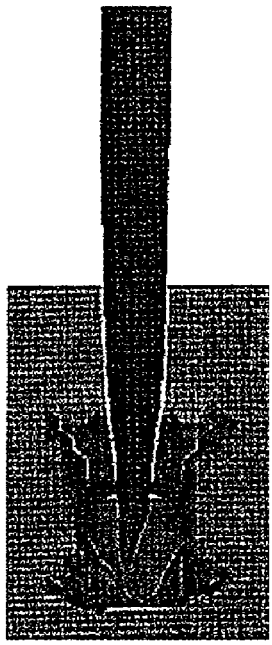

On the other hand, for a discharge port shown in FIG. 19A, the shape of projections is very blunted. The long side of the discharge port is defined as 20.6 μm, and the short side is defined as 7.7 μm. For a projection area X indicated by a broken lined quadrilateral in FIG. 19A, $x_1$ (direction toward the center of a discharge port) is regarded as 2.2 μm, and $x_2$ (width of the projection root) is regarded as 8.2 μm. $x_2/x_1=3.7$. A simulation for this is shown in FIG. 19B, which corresponds to the interval between (e) and (f) in FIG. 3, or (e) and (f) in FIG. 14. In FIG. 19B as well as in FIG. 18B, before a liquid pillar is separated from a liquid in the discharge port, holding of the liquid between the projections begins to break down, and the portion of the liquid pillar to be cut is dropped to the heater side in the discharge port. Thus, the length of the tail of a liquid droplet to be discharged does not become as short as the shape provided by the embodiment, and this causes the occurrence of satellites.

Figure 21B:
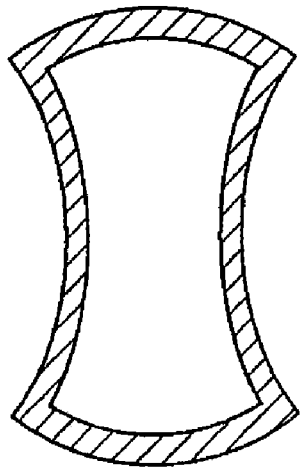

This is because, when a bubble is faded and the liquid in the discharge port is pulled in to the heater side, a force different from that in the embodiment is exerted to the meniscus. Since the projections in FIG. 19B are very blunted, there is almost no difference between the high fluid resistant portion that holds a liquid and the low fluid resistant portions that drop the meniscus to the heater side. Thus, during bubble fading, as indicated by the hatched portion in FIG. 21B, the liquid remains along the inner wall of the discharge port, and as indicated by the white portion, a force to pull the liquid to the heater side is exerted in the center portion of the discharge port, so that it is difficult that the liquid is held between the projections.

Other Shapes of Discharge Ports Applicable for the Present Invention

Figure 15:
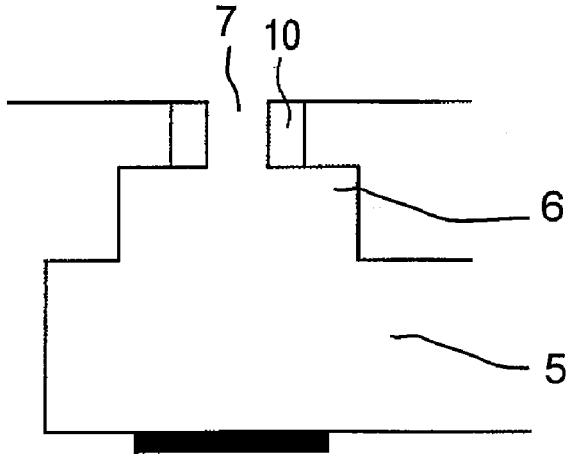
FIG. 15 is a schematic diagram showing an example head for this embodiment.
Figure 16A:
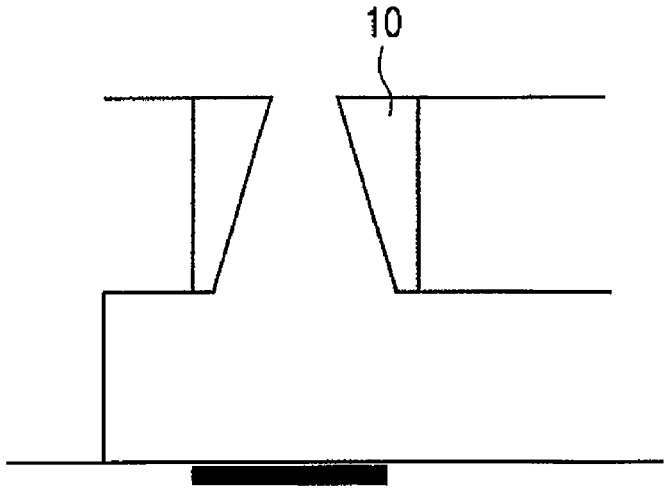
FIGS. 16A and 16B are schematic diagrams showing an example head according to the embodiment.
Figure 16B:
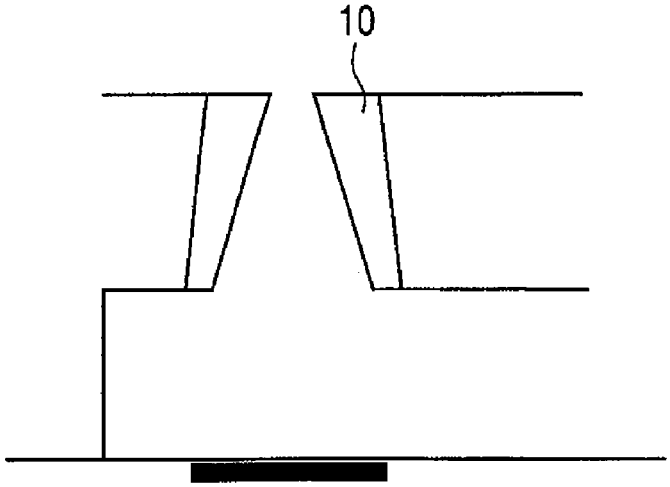

Next, in this embodiment, examples viewed from a direction perpendicular to a heater face are shown in FIGS. 15, 16A and 16B. The head structure in FIG. 15 is the shape wherein projections are formed for a two-step discharge port. A first discharge port 6 is formed to communicate with a flow path 5 above a heater; a second discharge port 7 smaller than the first discharge port is formed above the first discharge port 6; and projections 10 are formed on the second discharge port 7. Since the first discharge port is large, clogging of a liquid to be discharged can be suppressed, and a tiny liquid droplet can be formed through the second discharge port. Furthermore, the tail of a discharged liquid can be reduced at the projections of the second discharge port, and in addition, since the first discharge port portion having a small resistance is included, the discharge efficiency is improved. Further, since the forward resistance of the nozzle is reduced, a bubble easily grows upward in the discharge port, and during bubble fading, a meniscus can be pulled in the nozzle with a great force, so that the state wherein a liquid film is extended between the projections can be prepared earlier, and separation time for a liquid droplet is advanced.

FIGS. 16A and 16B are diagrams showing projections in tapered shapes. In FIG. 16A, a discharge port is formed linearly in the discharge direction, and projections are tapered so as to be narrowed in the discharge direction. In FIG. 16B, a discharge portion and projections are tapered so as to be narrowed in the discharged direction. Since the resistance in the discharge direction is reduced by employing such a shape, the same effects as provided by the above described two-step discharge port can be obtained, and such effects as the increase of the discharge efficiency and the reduction of a liquid droplet separation period are produced. Further, in FIG. 16B, the same tapered angle may be employed for the discharge port and the projections; however, it is preferable that the projections be more tapered in the discharge direction. When the inter-projection gap is narrower at the upper side of the discharge port (side close to the surface of the discharge port plate) than at the lower side (heater side), surface energy at the liquid held between the projections tends to be increased. The liquid film is rarely moved down to the lower side where the inter-projection gap is increased, and is easily held on the upper side. Therefore, as effects, the liquid to be discharged is easily separated at the position close to the surface of the discharge port plate, and the tail of a liquid droplet to be discharged is shortened.

In either case, it is preferable that the central axis of the discharge port portion in the liquid discharge direction be perpendicular to the surface of the discharge port and the heat generating element, and that both the two-step shape and the tapered shape symmetrical relative to the central axis of the discharge port portion, while taking into account the symmetries of meniscus positions and stability of discharging.

Figure 5A:
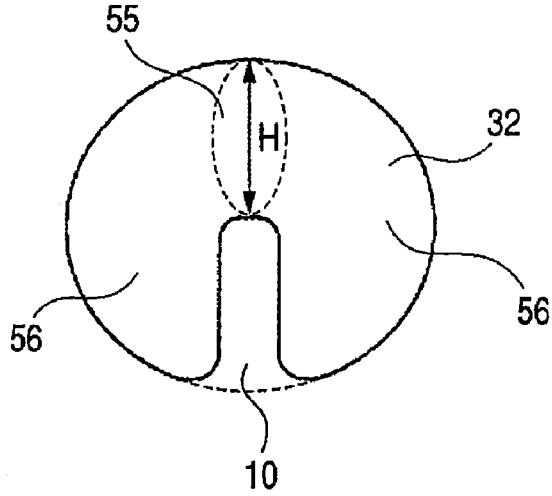
FIGS. 5A, 5B and 5C are schematic diagrams showing the discharge port shapes of the liquid discharge head applicable for the present invention, wherein one projection is formed, three projections are formed and two projections are formed along a circular discharge port, respectively.
Figure 5B:
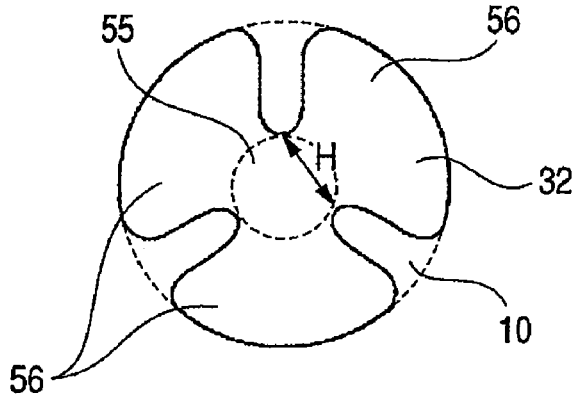
Figure 5C:
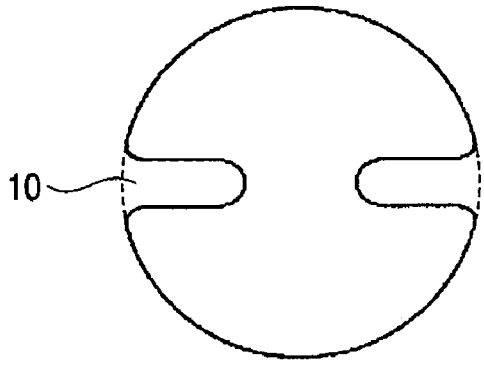

Furthermore, the number of projections is not limited to two, and a case of one projection as shown in FIG. 5A, or a case of three projections as shown in FIG. 5B is also included. When the number of projections is one, an inter-projection gap H denotes the shortest distance from the distal end of the projection to the outer edge of a discharge port. Further, a projection may be thinner than a member where a discharge port is to be formed. Furthermore, when there are a plurality of projections, different sizes may be provided for these projections. It is not preferable that too many projections be formed, because the shape of a discharge port becomes complicated, and clogging of a liquid easily occurs.

Method for Manufacturing a Liquid Discharge Head

So long as the substrate 34 can serve as one part of a flow path formation member, and can function as a support member for a heat generating element, a flow path, a discharge port plate, etc., its material is not especially limited, and glass, ceramics, plastic or metal, for example, can be employed. In this embodiment, an Si substrate (wafer) is employed as the substrate 34. Formation of discharge ports can be performed by using a laser beam, or also an exposure apparatus, such as an MPA (Mirror Projection Aligner) can be employed to utilize a photosensitive resin as the discharge port plate 35 to form discharge ports. Further, the flow path wall 36 is formed on the substrate 34 by a method such as spin coating, and the ink flow path wall 36 and the discharge port plate 35 can be obtained as one member at the same time. Or, discharge ports may be patterned through lithography.

Figure 11A:
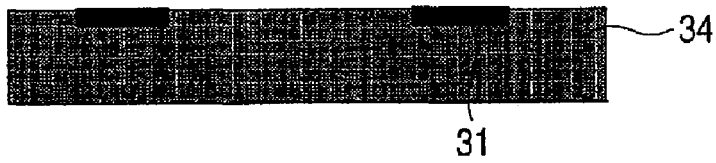
FIGS. 11A, 11B, 11C, 11D, 11E and 11F are schematic diagrams showing the processing for the manufacture of a liquid discharge head applicable to the present invention.
Figure 11B:
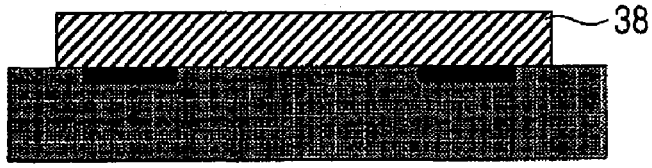
Figure 11C:
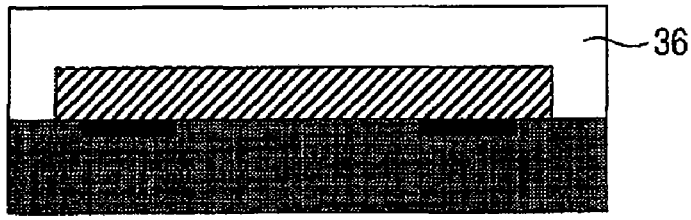
Figure 11D:
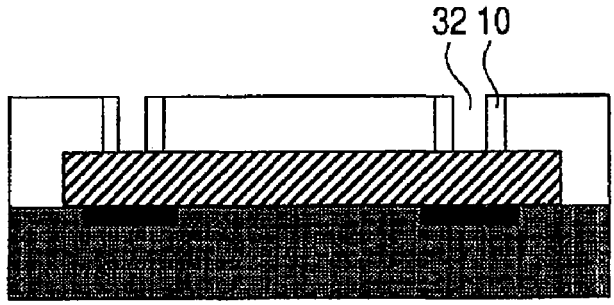
Figure 11E:
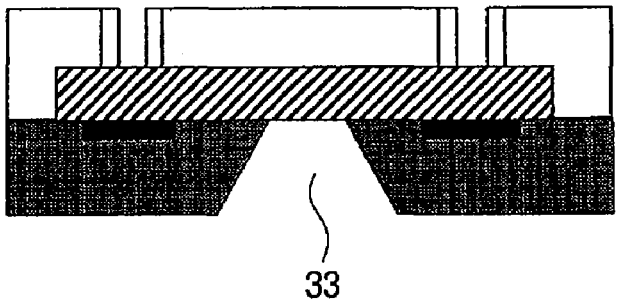
Figure 11F:
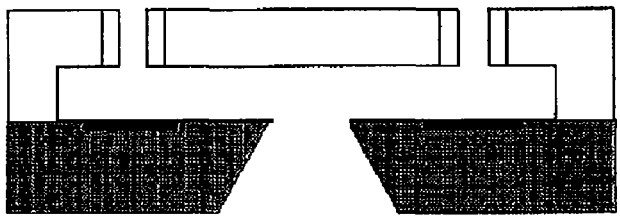

FIGS. 11A, 11B, 11C, 11D, 11E and 11F are schematic diagrams showing the head manufacturing processing for this embodiment. The silicon substrate 34 wherein a drive circuit and the heaters 31 are mounted is prepared (FIG. 11A). A photosensitive resin is applied to the silicon substrate 34 in FIG. 34A, and exposure and developing is performed to pattern a portion 38 serving as flow paths (FIG. 11B). Then, a photosensitive resin 36, which becomes a flow path wall and a discharge port plate, is applied so as to cover the portion 38 serving as flow paths (FIG. 11C). Exposure and developing is performed for the photosensitive resin 36 to pattern discharge ports 32 that include projections 10 in a convex shape (FIG. 11D). By employing the anisotropic etching technique that employs a difference of etching speeds due to the crystal orientation of silicon, the ink supply port 33 is formed from the reverse side of the flow path formation face of the silicon substrate 34 (FIG. 11E). Finally, a photosensitive resin 38 located at the flow path portions are melted by a solvent, and the melted portions become ink flow paths, and a hollow head is completed (FIG. 11F). For the thus obtained head portion, electrical mounting is performed, and a supply path, for supplying ink to the head portion from an ink tank, is formed, and a head cartridge is provided.

In order to confirm the effects of the present invention, heads having various structures were fabricated in the following embodiments, and evaluation was performed for the individual heads.

Embodiment 1

Comparison Example 1

In this embodiment and this comparison example, the state wherein a liquid was discharged was observed by stroboscopic photography, and a period required for separating a discharged liquid and the length of a liquid droplet from the distal end to the rear end of the liquid droplet immediately after the discharged liquid was separated were measured. It should be noted that the separation period for the discharged liquid is regarded as a period since a voltage was applied to heaters until a liquid pillar was separated from a liquid film. Power on time for the heaters was adjusted so that the discharge speed of 13 m/s was obtained. The physical property values of ink are: viscosity=2.1 cps, surface tension=30 dyn/cm and density=1.06 g/cm$^3$. The number of satellites is the average of ten samples of the number of satellites observed at one discharge. Further, the number of particles changed to a mist was also measured. The structures of the heads for embodiment 1 and comparison example 1, and the measurement results are shown in Table 1 below.

TABLE 1

| Discharge port form | Discharge port diameter ϕ [μm] | OH [μm] | Flow path height h [μm] | Projection shape [μm] Width a | Length b = $x_1$ | $x_2$ | $x_2/x_1$ | Discharged liquid separation period [μs] | Liquid droplet length [μm] | Satellite count (average of ten samples) |
|---|---|---|---|---|---|---|---|---|---|---|
| Embodiment 1 | 16.6 | 25 | 14 | 3 | 5.9 | 4.7 | 0.8 | 8.5 | 117 | 1.1 |
| Comparison Example 1-1 Circle | 16.6 | 25 | 14 | — | — | — | — | 11 | 156 | 3 |
| Comparison Example 1-2 Circle | 13 | 25 | 14 | — | — | — | — | 10 | 116 | 2.2 |

Inside the discharge port, a pair of projections 10 is so formed that, in the cross section of the discharge port in the discharge direction, the distal ends of the projections are directed to the gravity center of the discharge port, and the linear line connecting the distal ends runs through the center of the discharge port. In a projection area X, the length $x_1$ of the projections in a direction in which the projections are convex is equal to the projection length b. In the case of no projections, the minimum diameter M of the virtual edge of a discharge port denotes a distance from the root of one projection to the root of the other projection, and is equal to the diameter ϕ of the discharge port in the table. The largest diameter L of the discharge port is a value obtained by adding the projection width a to the value of ϕ in the table. The minimum diameter H of the discharge port denotes a gap between the projections, and is a value obtained by subtracting a value of b×2 from the value of ϕ. As for the relationship of the projection width a and the projection area $x_2$, since the root of the projection is extended by exposure through photolithography, the projection area $x_2$ is longer by several microns than the projection width a. In this embodiment, $x_2/x_1=0.8$, and $x_1 \geqq x_2$.

As shown in FIGS. 1A, 1B and 1C, the height h of the flow paths 5 is 14 μm. A distance (OH) from the heaters 31, which are heat generating elements, to the surface of the discharge port plate 35, is 25 μm. The size of each heater 31 arranged in the bubble chamber where bubbles are generated is 17.6×17.6 μm. The long side L of each discharge port is 19.6 μm. The short side M of the virtual outer edge of the discharge port, which is the distance from the root of one projection 10 to the root of the other projection, is 16.6 μm. The length b of the projection is 5.9 μm, the half-width a of the projection is 3 μm, and the distance H from the distal end of one projection to the distal end of the other projection is 4.2 μm. The distal ends of the projections 10 have a curvature diameter R of 2.2 μm, and are rounded. The discharge volume is about 5.4 ng. It should be noted that the projections are as thick as the discharge port plate. The discharge port has such a shape that a circle of a diameter ϕ16.6 μm is divided into two semi-circular portions, and projections are inserted between the semi-circular portions. Power to the heater was adjusted so as to obtain the liquid droplet discharge speed of 13 m/s, and discharge by this head was performed.

As a head for comparison example 1-1, a circular discharge port having a diameter of ϕ16.6 μm was employed. The other structure is the same as for embodiment 1. The discharge volume was 5.8 ng. According to the head in comparison example 1-1, the discharged liquid separation period was 11 μsec, while 8.5 μsec was required in embodiment 1, and the period until the discharged liquid was separated was considerably reduced in embodiment 1. The length of a liquid droplet was 117 μm in embodiment 1, and was 156 μm for the head in comparison example 1-1. This indicates that the length of a liquid droplet was reduced by a value equal to or more than a difference in separation time for the discharged liquid (discharge speed×separation time difference: 13 m/s×(11 μsec−8.5 μsec)=32.5 μm). The number of satellites at this time was the average of 1.1 in embodiment 1, and was 3 for the head in comparison example 1-1. Further, when the number of particles changed as a mist was measured, it was 15 in the embodiment, and was 3800 for the head in comparison example 1-1. As apparent from the above described results, the number of satellites is drastically reduced in the structure of this embodiment, compared with for comparison example 1-1.

Furthermore, in order to confirm satellite reduction effects of this invention, comparison example 1-2 shows an example discharge port that has a different discharge speed from that of embodiment 1, but has substantially the same length of a liquid droplet, and employs a circle having a diameter of 13 μm as the shape of a discharge port. The discharge volume at this time was 3 ng. By the head in comparison example 1-2, a discharged liquid separation period was 10 μsec, the length of a liquid droplet was 116 μm and the number of satellites was 2.2.

When this embodiment is compared with comparison example 1-2, it is found that the number of satellites is small for the head in this embodiment, although the lengths of the tails are almost equal. This indicates that, even when the length of the liquid droplet is shortened by reducing the period required until the discharged liquid is separated, this is not the only effect for the reduction of satellites. That is, according to the structure of this invention, while the tail is a little long, a speed difference between the main droplet portion and the rear end of the discharged liquid is very small because of a difference in the mechanism and timing for separation of the discharged liquid. This can also be considered as effective to the reduction of satellites. Further, by the discharged liquid separation mechanism, which is provided by the structure of this invention, the number of particles changed as a mist is also remarkably reduced, compared with the conventional structure.

Embodiment 2

Comparison Example 2

In Table 2, results obtained under the same conditions as in embodiment 1 described above are shown, except for the structure (the diameter of a discharge port, flow paths, an OH distance and projection shapes) of a head. Embodiment 2-1 is an example wherein projections are inserted between semi-circular portions of a diameter of 11 μm, as shown in FIG. 17, and the relationship between M, L and H and the values in the table is the same as that for embodiment 1. In this embodiment, $x_2/x_1=1.35$ and $x_1 \cdot x_2$, and the discharge quantity is 1.7 ng. Comparison example 2 employs a circular discharge port of a diameter of 11 μm, and the discharge quantity is 1.5 ng. According to the head having projections in this embodiment, the liquid separation time was advanced, compared with the circular one in comparison example. Further, it could be confirmed that the discharged liquid droplet was shortened, and the number of satellites was reduced. Additionally, the number of particles changed as a mist was sharply reduced.

TABLE 2

| Discharge port form | Discharge port diameter ϕ [μm] | OH [μm] | Flow path height h [μm] | Projection shape [μm] Width a | Length b = $x_1$ | $x_2$ | $x_2/x_1$ | Discharged liquid separation period [μs] | Liquid droplet length [μm] | Satellite count (average of ten samples) |
|---|---|---|---|---|---|---|---|---|---|---|
| Embodiment 2-1 | 11 | 17.5 | 7.5 | 3.5 | 4 | 5.4 | 1.35 | 4.5 | 55 | 0 |
| Comparison Example 2: Circle | 11 | 17.5 | 7.5 | — | — | — | — | 8 | 108 | 2.9 |

Embodiment 3

Comparison Example 3

In Table 3, results obtained under the same conditions as in embodiment 2 described above are shown, except for the structure (the diameter of a discharge port, flow paths, an OH distance and projection shapes) of a head.

Embodiments 3-1 to 3-5 are examples wherein projections of sizes written in the table are inserted between semi-circular portions of a diameter of 11 μm, as shown in FIG. 17, and the relationship between M, L and H and the values in the table is the same as that for embodiment 1. In these embodiments, the discharge quantity is 1.7 ng. In the range of $1.6 \geqq x_2/x_1$, as shown in embodiments 3-1 to 3-5, a small number of satellites was obtained as a result. Comparison example 3-1 employs a circular discharge port having a diameter of 11 μm, and the discharge quantity is 1.6 ng. Comparison example 3-2 employs the shape wherein projections of a length 0.7 are inserted between semi-circular portions of a diameter of 11 μm, and the discharge quantity is 1.7 ng. Here, in comparison example 3-2, $x_1$ of a projection area X is 0.7 μm and $x_2$ is 3.0 μm, and $x_2/x_1=4.3$. The discharged liquid separation time, the length of the liquid droplet and the satellites were all increased, compared with the embodiments.

TABLE 3

| Discharge port form | Discharge port diameter ϕ [μm] | OH [μm] | Flow path height h [μm] | Projection shape [μm] Width a | Length b = $x_1$ | $x_2$ | $x_2/x_1$ | Discharged liquid separation period [μs] | Liquid droplet length [μm] | Satellite count (average of ten samples) |
|---|---|---|---|---|---|---|---|---|---|---|
| Embodiment 3-1 | 11 | 20 | 7.5 | 2.1 | 3.3 | 3.5 | 1.1 | 6 | 79 | 1 |
| Embodiment 3-2 | 11 | 20 | 7.5 | 3.3 | 3.5 | 4.9 | 1.4 | 6 | 79 | 1 |
| Embodiment 3-3 | 11 | 20 | 7.5 | 3.5 | 4 | 5.4 | 1.4 | 6 | 76 | 1 |

TABLE 3-continued

| Discharge port form | Discharge port diameter φ [μm] | OH [μm] | Flow path height h [μm] | Projection shape [μm] Width a | Length $b = x_1$ | $x_2$ | $x_2/x_1$ | Discharged liquid separation period [μs] | Liquid droplet length [μm] | Satellite count (average of ten samples) |
|---|---|---|---|---|---|---|---|---|---|---|
| Embodiment 3-4 | 11 | 20 | 7.5 | 3.2 | 5.3 | 5.0 | 0.9 | 6.5 | 76 | 1 |
| Embodiment 3-5 | 11 | 20 | 7.5 | 2.6 | 2.9 | 4.6 | 1.6 | 6 | 79 | 1 |
| Comparison Example 3-1: Circle | 11 | 20 | 7.5 | — | — | — | — | 7.5 | 95 | 1.7 |
| Comparison Example 3-2 | 11 | 20 | 7.5 | 2 | 0.7 | 3.0 | 4.3 | 9 | 127 | 3.3 |

Embodiment 4

Comparison Example 4

In Table 4, results obtained under the same conditions as in embodiment 3 described above are shown, except in that the diameter of a discharge port was increased more.

Embodiment 4 is an example wherein projections of sizes written in the table are inserted between semi-circular portions of a diameter of 13 μm, as shown in FIG. 17, and the relationship between M, L and H and the values in the table is the same as that for embodiment 1. In this embodiment, $x_2/x_1=0.8$ and $x_1 \cdot x_2$. The discharge quantity is 2.3 ng. Comparison example 4 employs a circular discharge port having a diameter of 13 μm and the discharge quantity is 2.3 ng. According to this, for the head in this embodiment that has projections, it was confirmed that, compared with the circular one in the comparison example, the liquid separation time was advanced, the discharged liquid droplet was shortened and the satellites were reduced. The number of particles changed as a mist was also sharply reduced.

TABLE 4

| Discharge port form | Discharge port diameter φ [μm] | OH [μm] | Flow path height h [μm] | Projection shape [μm] Width a | Length $b = x_1$ | $x_2$ | $x_2/x_1$ | Discharged liquid separation period [μs] | Liquid droplet length [μm] | Satellite count (average of ten samples) |
|---|---|---|---|---|---|---|---|---|---|---|
| Embodiment 4 | 13 | 20 | 7.5 | 2 | 4.4 | 3.5 | 0.8 | 6 | 75 | 0.1 |
| Comparison Example 4: Circle | 13 | 20 | 7.5 | — | — | — | — | 8.5 | 118 | 2.6 |

Embodiment 5

Comparison Example 5

For Table 5, a head was employed by replacing the structure (a diameter of a discharge port, OH distance, the height of a flow path, the shapes of projections) with that for embodiment 4 described above. Further, power for the heaters was adjusted, so that the discharge speed for a liquid droplet was 18 m/s, and as physical property values of ink, viscosity=2.2 cps, surface tension=34 dyn/cm, and density=1.06 g/cm$^3$.

Embodiment 5 is an example wherein projections of the size written in the table were inserted between the semi-circular portions having a diameter of 14.3 μm, and the relationship between M, L and H and the values in the table is the same as that for embodiment 1. In this embodiment, $x_2/x_1=0.9$ and $x_1 \cdot x_2$. Comparison example 5 employs a circular discharge port having a diameter of 13.6 μm, and the diameter of the discharge port was selected so as to match the discharge quantity of 4.0 ng in embodiment 5. Since the discharge speed for a liquid droplet is faster than in the above embodiment, the number of satellites is increased more than in the above embodiment. However, for the head having projections in this embodiment, it could be confirmed that, compared with the circular one in comparison example, the liquid separation time was advanced, the length of the discharged liquid droplet was reduced and the satellites were reduced. Further, the number of particles changed as a mist were also drastically reduced.

TABLE 5

| Discharge port form | Discharge port diameter ϕ [μm] | OH [μm] | Flow path height h [μm] | Projection shape [μm] Width a | Length $b = x_1$ | $x_2$ | $x_2/x_1$ | Discharged liquid separation period [μs] | Liquid droplet length [μm] | Satellite count (average of ten samples) |
|---|---|---|---|---|---|---|---|---|---|---|
| Embodiment 5 | 14.3 | 26 | 16 | 3.3 | 5.5 | 5.1 | 0.9 | 11 | 207 | 4.9 |
| Comparison Example 5: Circle | 13.6 | 26 | 16 | — | — | — | — | 12 | 217 | 6.5 |

As described for the individual embodiments above, by using the head of the embodiments, the degrading of an image quality due to satellite liquid droplets or a mist can be reduced. Further, in the above embodiments, an example using heaters as energy generating elements has been employed. However, the present invention is not limited to this, and can be applied for a case using, for example, a piezoelectric member. In the case of employing a piezoelectric member, a bubble fading process is not required, but by applying an electric signal to the piezoelectric member to expand a liquid chamber, the meniscus can be pulled inside a discharge port.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-343943, filed Nov. 29, 2005, which is hereby incorporated by reference herein in its entirety.

What is claimed is:

1. A liquid discharge method for discharging liquid from a discharge port by applying energy to the liquid, said method comprising the steps of:

driving liquid through the discharge port, which includes, in a cross-section of the discharge port, with respect to a liquid discharge direction, two projections projecting toward an inside of the discharge port, as a pillar-shaped liquid stretching externally from the discharge port in the liquid discharge direction;

retracting a liquid surface that is positioned on both sides of the two projections and an area between the two projections in the discharge port in a direction opposite to the liquid discharge direction while the liquid positioned in the area is connected to the pillar-shaped liquid and in contact with distal ends of the two projections; and separating the pillar-shaped liquid from the liquid positioned in the area to discharge the liquid from the discharge port while the liquid positioned in the area is in contact with the distal ends of the two projections after the retracting is commenced.

2. A liquid discharge method according to claim 1, wherein the energy applied to the liquid is thermal energy generated with a heat generating element and a bubble is formed in the liquid by the thermal energy, and wherein when a volume of the bubble is reduced, the liquid in the discharge port is retracted in the direction opposite to the liquid discharge direction.

3. A liquid discharge method according to claim 2, wherein the bubble does not communicate with atmospheric air.

4. A liquid discharge method according to claim 2, wherein the bubble communicates with atmospheric air.

5. A liquid discharge method for discharging liquid from a discharge port by applying energy to the liquid, said method comprising the steps of:

driving liquid through the discharge port, which includes, in a cross-section of the discharge port, with respect to a liquid discharge direction, one projection projecting toward an inside of the discharge port, as a pillar-shaped liquid stretching externally from the discharge port in the liquid discharge direction;

retracting a liquid surface that is positioned on both sides of the projection and an area between a distal end of the projection and an edge of the discharge port, opposite to the distal end of the projection in the discharge port in a direction opposite to the liquid discharge direction while the liquid positioned in the area is connected to the pillar-shaped liquid and in contact with the distal end of the projection and the edge of the discharge port; and separating the pillar-shaped liquid from the liquid positioned in the area to discharge the liquid from the discharge port while the liquid positioned in the area is in contact with the distal end of the projection and the edge of the discharge port after the retracting is commenced.

6. A liquid discharge method for discharging liquid from a discharge port by applying energy to the liquid, said method comprising the steps of:

driving liquid through the discharge port, which includes, in a cross-section of the discharge port, with respect to a liquid discharge direction, three projections projecting toward an inside of the discharge port, as a pillar-shaped liquid stretching externally from the discharge port in the liquid discharge direction;

retracting a liquid surface that is positioned on both sides of the projections, in the discharge port in a direction opposite to the liquid discharge direction while the liquid positioned in the area is connected to the pillar-shaped liquid and in contact with distal ends of the three projections; and separating the pillar-shaped liquid from the liquid positioned among the distal ends of the three projections to discharge the liquid from the discharge port while the liquid positioned in the area is in contact with the distal ends of the three projections after the retracting is commenced.

* * * * *